US011612780B2

(12) United States Patent
McClain

(10) Patent No.: US 11,612,780 B2
(45) Date of Patent: Mar. 28, 2023

(54) EXERCISE MACHINE ADJUSTMENT KIT AND METHODS OF USING THE SAME

(71) Applicant: Richard McClain, Clovis, CA (US)

(72) Inventor: Richard McClain, Clovis, CA (US)

( * ) Notice: Subject to any disclaimer, the term of this patent is extended or adjusted under 35 U.S.C. 154(b) by 83 days.

(21) Appl. No.: 17/458,175

(22) Filed: Aug. 26, 2021

(65) Prior Publication Data

US 2023/0069355 A1 Mar. 2, 2023

(51) Int. Cl.

| | |
|---|---|
| ***A63B 21/062*** | (2006.01) |
| ***A63B 21/068*** | (2006.01) |
| ***A63B 22/00*** | (2006.01) |
| ***A63B 21/078*** | (2006.01) |
| ***A63B 21/00*** | (2006.01) |

(52) U.S. Cl.

CPC .... *A63B 21/0622* (2015.10); *A63B 21/00058* (2013.01); *A63B 21/068* (2013.01); *A63B 21/078* (2013.01); *A63B 21/4029* (2015.10); *A63B 22/0076* (2013.01); *A63B 2225/093* (2013.01)

(58) Field of Classification Search

CPC . A63B 21/0622; A63B 21/068; A63B 21/078; A63B 21/00047; A63B 21/00058; A63B 21/4029; A63B 21/4027; A63B 21/4033; A63B 22/0076; A63B 22/0087; A63B 2225/093

See application file for complete search history.

(56) References Cited

U.S. PATENT DOCUMENTS

| | | | | |
|---|---|---|---|---|
| 2,439,854 | A | 4/1948 | Lipski | |
| 5,169,363 | A * | 12/1992 | Campanaro | A63B 21/0628 482/142 |
| 7,766,801 | B2 | 8/2010 | Campanaro et al. | |
| 7,775,950 | B2 * | 8/2010 | Campanaro | A63B 21/0622 482/130 |
| 8,075,457 | B2 * | 12/2011 | Campanaro | A63B 21/068 482/130 |
| 8,696,528 | B2 | 4/2014 | Campanaro et al. | |
| 10,426,991 | B2 * | 10/2019 | Barnett | A63B 21/0552 |
| 2010/0248911 | A1 * | 9/2010 | Myers | A63B 21/0622 482/96 |
| 2021/0213324 | A1 * | 7/2021 | Modeste | A63B 22/0023 |
| 2022/0072364 | A1 * | 3/2022 | Pearson | A63B 22/0005 |

OTHER PUBLICATIONS

Total Gym Supreme Owner's Manual, retrieved May 11, 2021 from "https://totalgymdirect.com/manuals/TG_Supreme.pdf".

* cited by examiner

*Primary Examiner* — Megan Anderson

(74) *Attorney, Agent, or Firm* — Sierra IP Law, PC; William K. Nelson

(57) ABSTRACT

The present invention provides exercise attachments for modifying an inclinable weightlifting system using a user's body weight. A pair of vertical support devices providing rigidity and elevate the weightlifting system off the ground to aid in a user mounting and dismounting the system. A pair of adapter arms enable a user to tailor exercise attachments to target specific muscle groups and specific regions of that muscle group. The pair of vertical support device and pair of adapter arms may be incorporated into an inclinable weightlifting system to enable a user to perform various rowing and bench press exercises.

21 Claims, 19 Drawing Sheets

EXERCISE MACHINE ADJUSTMENT KIT AND METHODS OF USING THE SAME

FIELD OF THE INVENTION

The present invention relates generally to accessories for exercise equipment and methods of using the same. More particularly, the present invention relates to exercise accessories and systems operable to adjust operating positions of exercise equipment to add or improve exercises to exercise equipment and to aid in mounting and dismounting the exercise equipment.

BACKGROUND OF THE INVENTION

Home exercise is becoming increasingly popular. Home exercise offers the health benefits of regular exercise while recognizing that many people have difficulty finding sufficient time in their schedule for a complete workout at a health club or gymnasium. Home exercise, however, has its drawbacks. In particular, in order to exercise all or most of the muscle groups, multiple pieces of home exercise equipment may be required. Furthermore, these multiple pieces of equipment may require permanent installation in the home. Solutions for such systems include a multi-exercise or universal gym equipment system. Such systems may include an adjustable ramp that allows the user to change the angle of the exercise equipment (e.g., a bench).

Such exercise systems can include a collapsible exercise device including a vertical support member, an adjustable incline having a first end (e.g., fixed ground) and a second end (e.g., inclinable ground), the first end of the adjustable incline is pivotally coupled to, adjustable supported by, and vertically movable with respect to, the vertical support member for adjusting the incline of the adjustable incline, a user support platform slidably attached to the adjustable incline, first and second combination pulley-support and pull-up bars each pivotally connected to the first end of the adjustable incline for movement between at least a substantially vertical position and a substantially non-vertical position, first and second pulley-support and pull-up bars for movement of the pulleys to a desired location, and one or more cables extendable through the first and second pulleys and connected to the user support platform for movement of the support platform along the adjustable incline through cable movement, wherein the exercise device is foldable such that the vertical support member and the adjustable incline are substantially parallel to each other when collapsed; positioning the first end of the adjustable incline at a desired height with respect to the vertical member so that the first adjustable incline is at a desired inclination, and a user is operable to manipulate the weightlifting system with the user's body weight.

The system is placed on the ground and the second end may slidably engage with the ground to the desired distance away from the first end, and a user may mount onto the slidable platform and engage with an exercise attachment (e.g., dip bar, pull-up bar, etc.) and may perform a workout. Workouts may include a shoulder press, crunches, pull-ups, but do not provide an attachment for performing a traditional bench press or an upright row. When arranged for providing the least resistance, such systems are configured such that the platform adjustable incline is substantially parallel to the ground, and mounting and dismounting the system can be a tiring and cumbersome activity for individuals who have trouble getting up and down from the floor. A lower resistance configuration is typically used by individuals who are working their way towards increasing the resistances, but struggle to mount and dismount the system. In addition, such exercise attachments are configured for attachment to various fixed locations along the railing of the inclinable supports, and a user may struggle with the added intensity of interacting with the exercise attachments at a given mounting location. For example, a wing attachment may be attached nearest to the first end, may provide a gripping location for a user to perform pull-ups and chin-ups exercises for various upper body muscle groups in the arms, shoulders, and back. Another attachment may be a press-up bar that may be attached nearest to the second end, and to enable a user to perform a shoulder press exercise.

Thus, there is a need to provide an elevating device and method for raising the inclinable exercise system off the ground allowing a user to mount and dismount the system without requiring a user to mount the system from the ground easily and function of the inclinable exercise system. Additionally, there is a need to provide an attachment adapter that allows a user to adjust the angle at which a user's arms interface with the exercise attachment, enabling a user to modify the intensity and difficulty of exercises resulting from exercise attachment placement

SUMMARY OF THE INVENTION

The present invention involves an adjustment kit for use with exercise equipment (e.g., a multiple exercise system having an adjustable bench), and a method of using such a system. The method includes modifying exercise equipment device that includes a bench surface for the user to sit, lay, or kneel on. The bench may be mounted on a frame having vertical support members that support the weight of the bench. The bench may be pivotally adjustable on the frame to adjust the incline of the bench surface. In some embodiments, the bench may movably connected to a track, such that the bench slides along the track, and the incline angle of the bench and track maybe pivotably adjustable on the frame. The kit may include vertical adjustment frames on which the exercise equipment device may be positioned, such that the exercise equipment device (importantly the bench) is raised relative to the default height of the exercise equipment device. The vertical support members of the exercise equipment device may be seated in the vertical adjustment frames, which may raise the level of the exercise equipment device. The vertical adjustment frames may place the exercise equipment at a more comfortable height for the user, thereby enabling easier mounting and dismounting of the exercise equipment and the use of the exercise equipment for additional exercises that were not practicable because of the proximity of the bench surface to the ground.

The kit may also include attachable handle bar that are operable to attach to the frame of the exercise equipment to add exercises performable on the exercise equipment. For example, the attachable handle bars may be attached such that they flank the bench surface of the exercise equipment to allow the exercise equipment to be used to perform a rowing exercise that is not performable on the original exercise equipment. The kit of the present invention is adaptable to various all-in-one exercise equipment, such as Total Gym™, Pilates machines, and other exercise equipment that utilize sliding bench and/or body weight resistance exercise routines.

In one embodiment, the present invention provides two vertical support frames that may be removably coupled to a first vertical support member and a second vertical support member of an exercise equipment, thereby raising the exercise equipment off the ground and allowing a user to mount and dismount the system more easily and allowing the bottoms of a user's feet to interface with the ground during exercise. Each vertical support frame may have parallel vertical legs that are connected with at least one crossmember. Each of the parallel vertical legs may have a proximal and a distal end, wherein the proximal end may be connected to a receiver (e.g., a channel), and a distal end connected to a sled. The channel may have a geometry complementary to an exterior shape of a base of a vertical support member of the exercise equipment. In some examples, the geometry of the receiver and the exterior shape of the base of the vertical support member may both be substantially circular or rectangular. The receiver may have a geometry that allows the base of the vertical support to sit within the receiver such that the centroid of the base aligns with the centroid of the receiver. The receiver's outer ends may be a through-hole for receiving a fastener operable to removably couple the vertical adjustment frame to the vertical support member.

Each vertical support frame may have two horizontal sleds, each positioned at the inferior end of the parallel vertical leg. The two sleds may be oriented in parallel to one another. In some embodiments, the sleds may be positioned in parallel in a bench of the exercise system. In some embodiments, the sleds may each have at least a portion of its bottom that is smooth and interfaces with the ground or floor on which it is positioned. The smooth surface of the sleds may be present to allow sliding along the ground or floor on which the vertical support frame is positioned. Such sliding may aid in adjusting the exercise equipment that results in shorting of the size or length of the exercise equipment. For example, the exercise equipment may have a pivoting bench, the angle of which may be adjusted resulting in a change in the distance between the vertical support legs at each end of the exercise equipment.

The vertical support frames may be manufactured from weldable materials such as steel, aluminum, carbon fiber composites, structural plastics, and the like. In some embodiments, the sleds may have a ground interface surface material operable to provide more slip, such as Delrin, PEEK, acetal, and similar plastics. In another embodiment, the sleds may have a ground interfacing surface a tactile rubber sleeve preventing the sled from moving from the fixed location. For example, the sled of the elevating devices attached to the vertical support may have the tactile rubber sleeve preventing slip, and the sled of the elevating devices attached to the inclinable ground end may have a low coefficient of friction, allowing for slip of the sled.

The position of the exercise system may be adjusted and/or inclined by positioning the first adjustable vertical support member at a desired height with respect to the vertical member of the exercise system so that the first vertical member of the exercise system is at a preferred height, and positioning the second adjustable vertical support member at a desired height with respect to the second vertical member of the exercise system so that the second adjustable incline is at a preferred height. The first and second vertical support members may be set at different heights to create an inclined position of the bench of the exercise system. In some embodiments, the first and second vertical support members may be telescopically adjusted (e.g., by nested, slidable vertical rods) to a selectable height.

The present invention also provides an attachment adapter system operable to interface with a series of predetermined through-hole locations on railing or tubing of the exercise system and may be removably attached to the through-hole with a pin or other locking mechanism (e.g., a hatch pin, cotter pin, thread fastener (e.g., nut and bolt), a pin and clevis, or other mechanical fastening structure). The attachment adapter system may have a bracket comprising two parallel flanges having aligned through-holes at or near the center of the flanges. The bracket may be connected to an elongated arm with a neutral axis that forms an angle with a top surface of the bracket. The angle formed may be oblique (e.g., substantially acute). On the neutral axis of the elongated arm may be a plurality of through-holes operable to receive various exercise attachments. (e.g., wing attachment, press-up bars, etc.) The pin may be a hatch pin, cotter pin, thread fastener (e.g., nut and bolt), a pin and clevis, or other mechanical fastening structure.

Accordingly, it is one aspect of the present to provide a kit for adjusting an angle and/or a height of and add exercise functionality to a user-manipulated weightlifting system using a user's body weight, the system comprising: at least one vertical support frame having a pair of parallel legs longitudinally connected with a detachable crossmember, wherein each parallel leg has a distal end connected to a sled and a proximal end connected to a receiver, wherein the receiver has a geometry operable to receive a stand member of said exercise system, and a fastener operable to penetrate through said receiver's periphery sides and secure said stand member to the receiver. The frame may be secured to the stand member with a threaded fastener that penetrates the receiver's periphery into the stand member ground. The sleds may have a low coefficient of friction and may be operable to engage with the floor slidably and provides stability when the attachment device is loaded with a user's body weight. The crossmember may be connected to the parallel legs with a pinned connection. The vertical support frame may be operable to elevate the weightlifting system off the ground at least twelve inches, allowing a user to mount and dismount the system without having to lay on the floor. The receiver geometry may be complementary to the geometry of a stand member ground interface. The kit may further comprise a pair of elongated attachment arms comprising: a bracket including a pair of flanges positioned at a distal end of the elongated arm having a through-hole operable to be fastened to the weightlifting systems to attach an exercise accessory, where the through-holes are complementary to a plurality of through-holes along rails or slides for a bench of the exercise system. The elongated attachment arm may fasten to at least one through-hole of a plurality of through-holes on a rail of a pair of rails of the weightlifting system at symmetrical locations. The bracket and central axis of the elongated arm form an oblique angle (e.g., an acute angle), where the vertex of the acute angle may be configured away from the centroid of the weightlifting system. The elongated arm may be secured to a through-hole nearest to a frame of said weightlifting system to configure the system for a rowing exercise. The elongated arm is secured to a through-hole farthest from the frame of said weightlifting system to configure the system for a bench press exercise. The elongated arm through-holes are positioned perpendicular to the plane of symmetry of the elongated arm.

It is another aspect of the present invention to provide a kit for modifying a weightlifting system, comprising attaching a vertical support device having a pair of parallel legs longitudinally connected with a detachable crossmember, where each parallel leg has a distal end connected to a sled and a proximal end connected to a receiver, where the receiver has a geometry operable to receive a base member of the weightlifting system, and a fastener operable to mechanically connect the receiver and secure the base member of the weightlifting system to the receiver, and an elongated exercise attachment arm including: a bracket comprising two parallel flanges having aligned through-holes at or near the center of said flanges, and an elongated arm secured to the top of the plate wherein the elongated arm may be fixed at an oblique angle (e.g., an acute angle) and may have at least one through-hole along the central axis of the elongated arm. The kit may be used in a method of adjusting and improving the weightlifting system by a user. The user may align the receiver of a first vertical support member under a base member of the weightlifting system, and may removably secure the vertical support device to the system with a fastener, where the first vertical support device may carry the weight of the weightlifting system and secure the frame in place. A user may align the receiver of a second vertical support device to an extendable base member of the weightlifting system, and removably secure the second vertical support device to the extendable base member with a fastener. The receivers of the vertical support devices may rotate about the fastener and may allow the vertical support device to rotate when a user changes the angle of the bench of the weightlifting system. Each of the first and second vertical support device may each include sleds. The sled of the second elevating device may be operable to slidably engage with the ground allowing for a movable foundation and allow the vertical support device to slide along the ground if the user extends the extendable base member to raise an end of the weightlifting system (e.g., to increase and incline of a bench of the weightlifting system) such that the distance between the first vertical support device and the second vertical support device is reduced. The sliding functionality of the sleds lends efficiency to the process of adjusting the incline of the bench and the distance between the vertical support members. A user may also align the bracket of the elongated exercise attachment arms to a through-hole on a rail or track of the weightlifting system and secure the bracket with a mechanical connection mechanism. A user securing an exercise accessory to at least one through-hole of said elongated arm, and a user configuring the weightlifting system at their desired resistance level and mounting on top of a slidable pad or bench between the railing of the weightlifting system to perform an exercise, the exercise may be dependent on the configuration of the attachment arms and the direction of the vertex of the attachment arm. The weightlifting system may have telescopic rails to which the attachments arms are connected. In some embodiments, the crossmember of the vertical support devices may be operable to configure the sleds in a distance operable to nest base member of the weightlifting system in the receiver of the vertical support device. The vertical support device may be operable to raise the inclinable weightlifting system off the ground at least twelve inches. The elongated arm may have a length of at least twenty-four inches. The configuration of the attachment arms and the direction of the vertex may allow a user to perform an assisted bench-press, an upright row, an incline row, a shoulder press, dips, and other upper body exercises that would not otherwise be possible in the absence of the kit.

Further aspects and embodiments will be apparent to those having skill in the art from the description and disclosure provided herein.

It is an object of the present invention to provide an elevating device that substantially elevates a weightlifting system off of the ground and increases the resistance of a weightlifting system using a user's body weight.

It is a further object of the present invention to provide an elevating device that substantially elevates a weightlifting system off of the ground and decreases the resistance of an inclinable weightlifting system using a user's body weight.

It is a further object of the present invention to provide an attachment arm for incorporation with an inclinable weightlifting system that is operable to provide a plurality of attachment points for an exercise attachment for a user to configure the system to accommodate varying arm lengths.

It is a further object of the present invention to provide an elevating device that aids in a user's ability to mount and dismount the system It is a further object of the present invention to provide an attachment arm the enables a user to target specific muscle groups and specific regions within that muscle group.

It is a further object of the present invention to provide an attachment arm and elevating device operable to allow a user to perform a rowing exercise and a bench press exercise.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Figure 1:
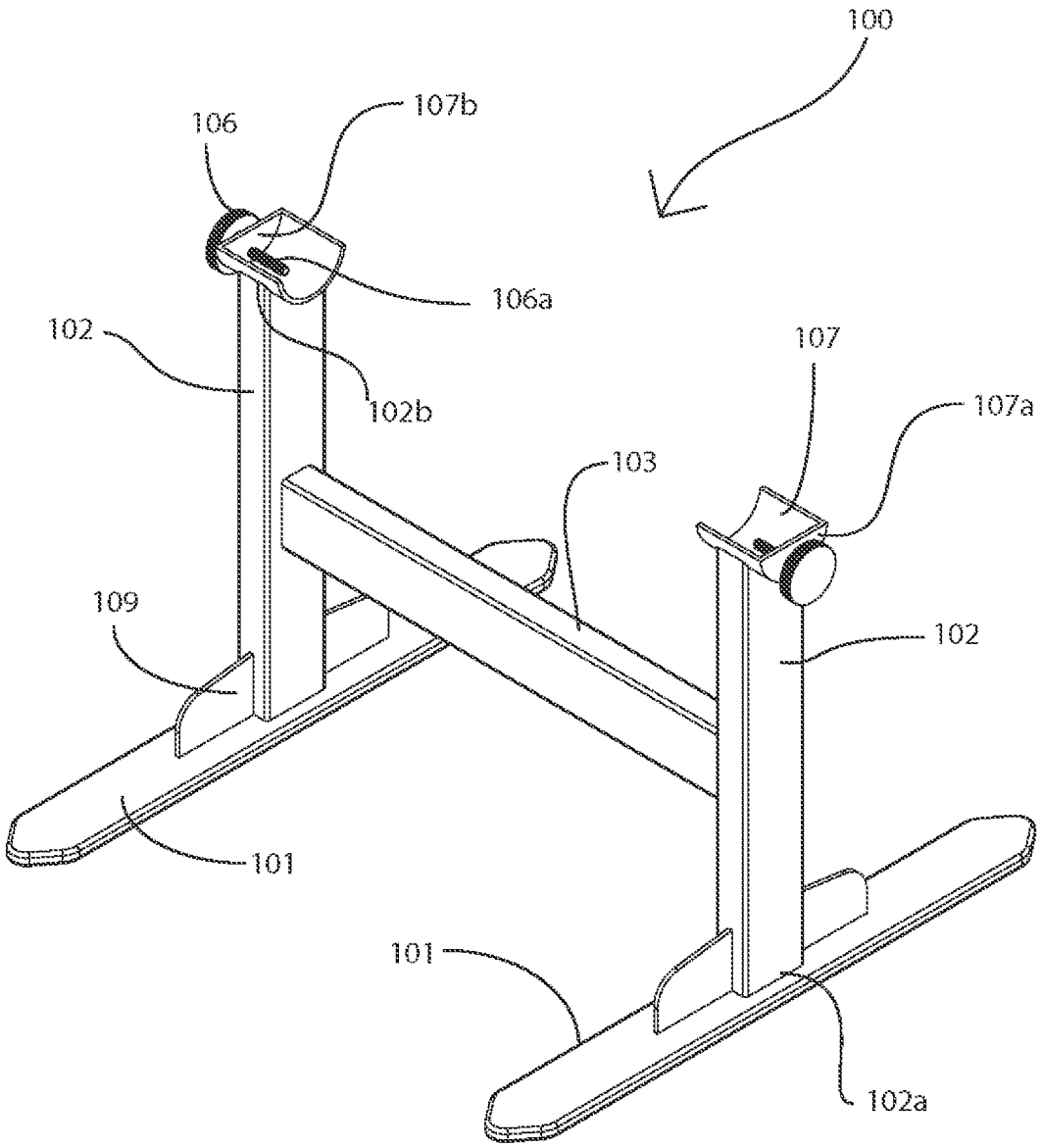
FIG. 1 provides a perspective view of an exercise attachment device, according to an embodiment of the present invention.
Figure 2:
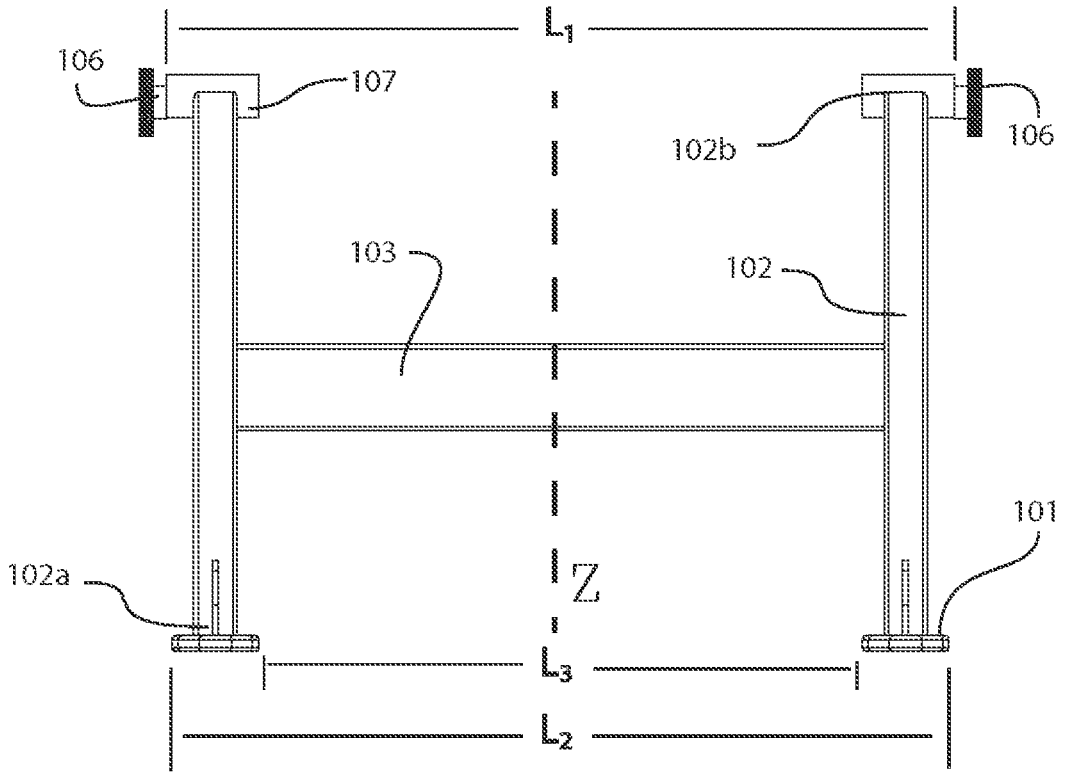
FIG. 2 provides a front and rear view of an exercise attachment device, according to an embodiment of the present invention.
Figure 3:
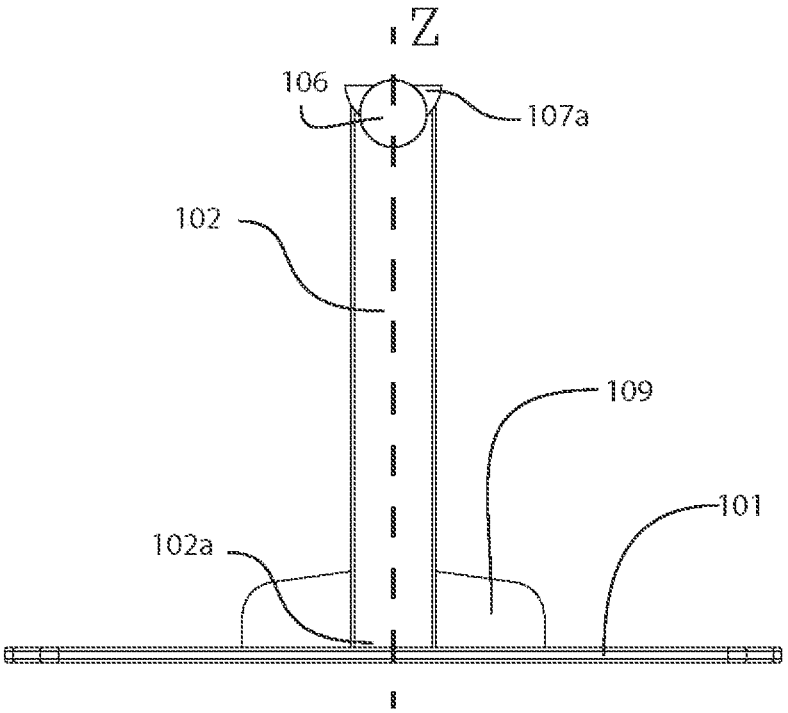
FIG. 3 provides a side view of an exercise attachment device, according to an embodiment of the present invention.

The present invention concerns exercise attachment devices that may be incorporated into an weightlifting system 1000, a user-manipulated weightlifting system that utilizes the user's body weight for resistance, or other weight lifting equipment. FIGS. 1-5 provide views of an exemplary vertical support device 100 (e.g., elevation device) according to an embodiment of the present invention. The elevation device 100 may be operable to provide a stable platform that is balanced and has symmetry about a vertical axis Z at the intersection of the front plane (X) and right plane (Y) of the elevation device 100. The elevation device 100 may be comprised of a frame having two elongated legs 102, a crossmember 103 that may be operable to connect the elongated legs 102, and may configure each of the legs parallel about the right plane Y. On the distal end 102*a* of the elongated leg 102 a sled 101 may be fixedly attached to the elongated leg 102 and may be operable to interface with the ground allowing for slip under a low loading condition and may have a low friction coefficient. On the proximal end 102*b* of the elongated arm 102, there may be a receiver 107 (e.g., flange). The receiver 107 may have a threaded through-hole from the outer face 107*a* to the inner face 107*b* operable to receive the threading 106*a* for a fastener 106. The two elongated legs 102, crossmember 103, receiver 107, and sleds 101 may be manufactured from rigid materials such as steel, aluminum, iron, and other robust materials. In other embodiments, the molded from carbon fiber composites, structural plastics, and the like. The two elongated legs 102 may have a cross-sectional geometry that is substantially square, rectangular, circular, or may be an I-beam or H-beam. The two sleds 101 may have a gusset 109 (e.g., ribbing) that is operable to aid in fixing the elongated arm 102 to the sleds 101 and may provide support and rigidity to the structure. As shown in FIG. 2, the crossmember 103 may position the sleds 101 at a distance that may be substantially equal to the original width of the weightlifting system, where the distance $L_2$ between the lateral edges of sleds 101 does not exceed the outer length of the exercise equipment and an inner length of $L_3$ is less than the width of a base member of the weightlifting system to be positioned in the receivers 107. The length $L_1$ provides a measurement for the exterior width for receiving the base member of the weightlifting system. The receivers 107 may have a generally circular or ovoid curvature that is complementary to a geometry of the base member of the weightlifting system 1000. For example, the receiver 107 may have a cross-sectional shape that is less than or equal to half circle or half ellipse. In some embodiments, the receiver 107 may be fabricated to have a matching In other embodiments, the receivers 107 may have other geometries, for example, they may be substantially rectangular, square, or other polygonal shapes or portions of polygonal shapes.

Figure 4:
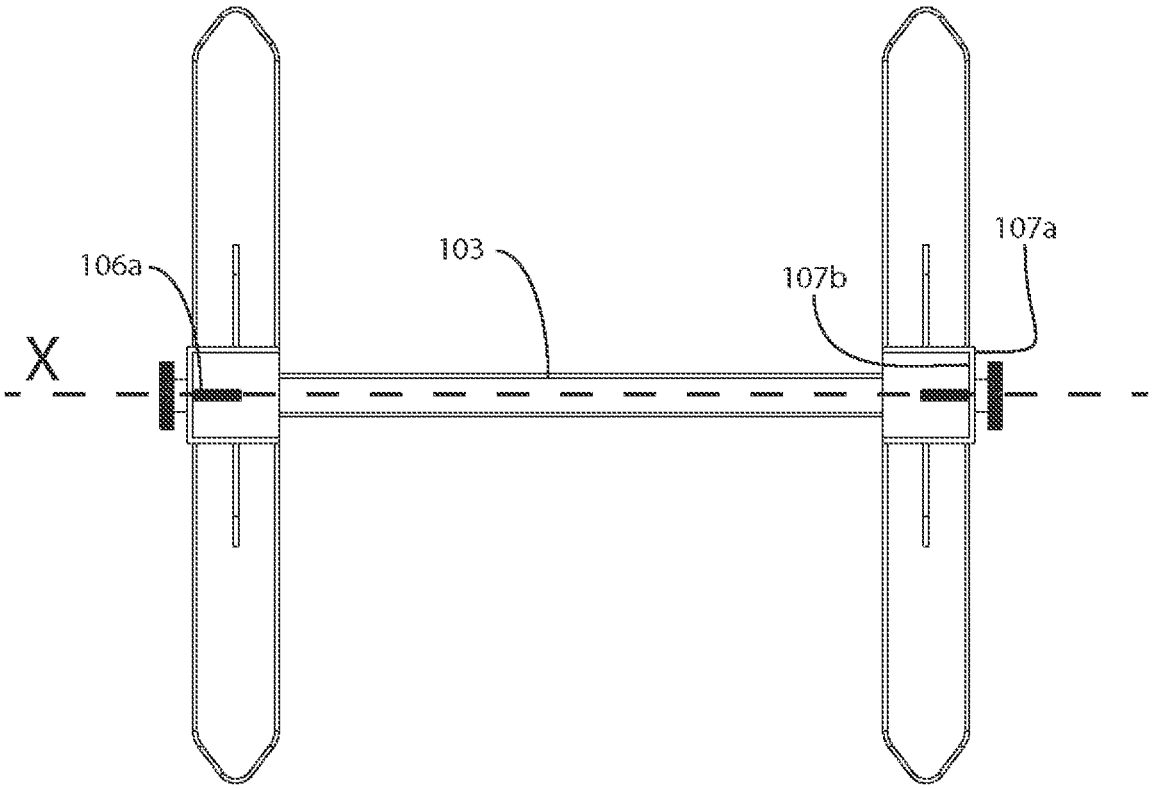
FIG. 4 provides a top view of an exercise attachment device, according to an embodiment of the present invention.
Figure 5:
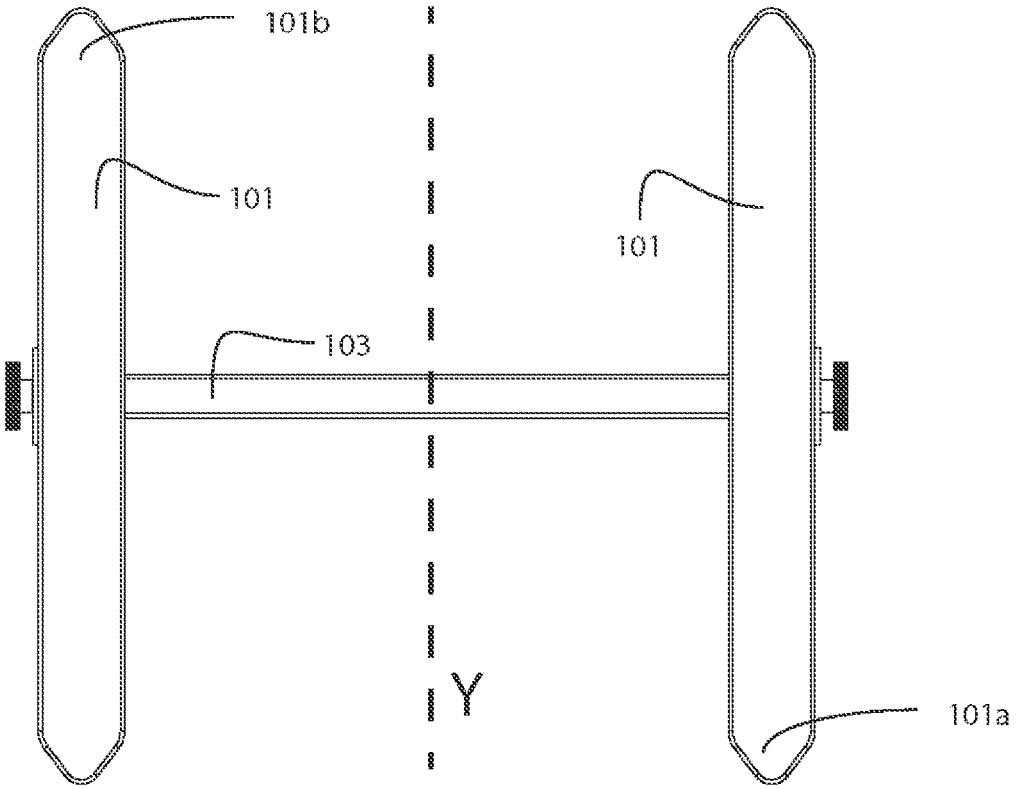
FIG. 5 provides a bottom view of an exercise attachment device, according to an embodiment of the present invention.

FIG. 4 illustrates a top view of the exemplary vertical support device 100 and provides an example of the symmetry and mirror image of the device 100 about the front plane X, and FIG. 5 shows the symmetry of the device 100 about the right plane Y. In some embodiments, there may be a gusset 109 providing stability between the sled 101 and the elongated leg 102. The bottom surface of sleds 101 may be substantially uniform and may have a tapering point at the leading and trailing ends 101*a*, 101*b* and may be operable to prevent snagging on the floor.

Figure 6:
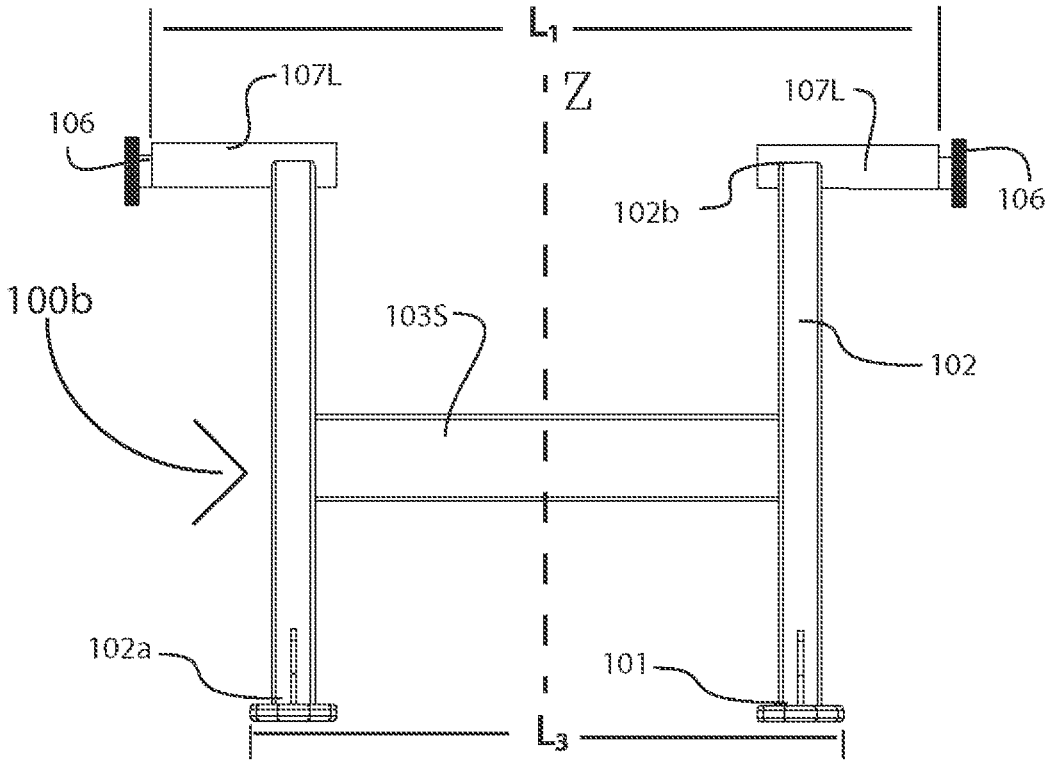
FIG. 6 provides a front view of an exercise attachment device, according to an embodiment of the present invention.

In some embodiments, as shown in FIG. 6, the exemplary vertical support device 100*b* may provide all of the same components of the device 100 but provides a smaller footprint. In such embodiments, the device may have a nesting characteristic that allows the device 100 to be secured to the weightlifting system and enables the system's storage. Comparing FIGS. 2 and 6 the device 100*b* may have an outer distance $L_3$ between sleds 201 that is less than or equal to the inner length $L_1$ of the device 100 (FIG. 2) the reduction of the sled 101 footprint allows the vertical support devices 100*b* to nest in between the sleds 101 of device 100, while maintaining the receiver length $L_1$. The elongated legs 102 may have the same dimensions and are still attached at the distal end 102*a* to the sleds 101, and the proximal end 102*b* may still be attached to the receiver 107L. In such embodiments, the receiver 107 may be modified to have a longer length 107L, and the crossmember 103S may be shortened. The vertical support devices 100 and 100*b* may work in unison to allow for easy installation and increased mobility; this is discussed in more detail below.

Figure 7:
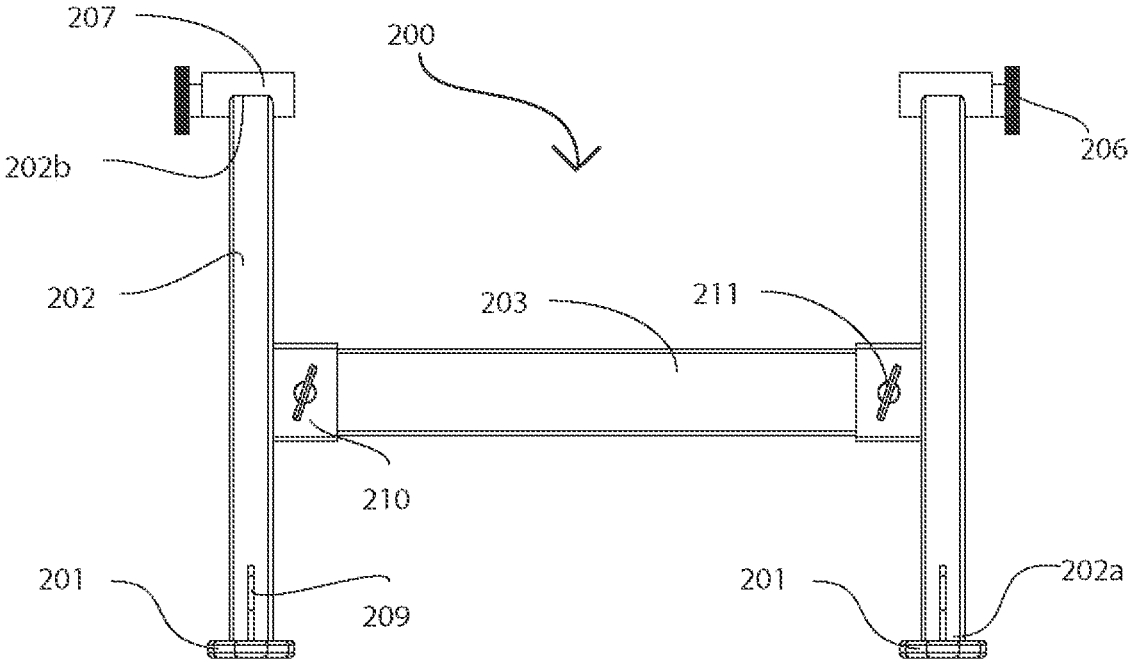
FIG. 7 provides a front view of an exercise attachment device, according to an embodiment of the present invention.
Figure 8:
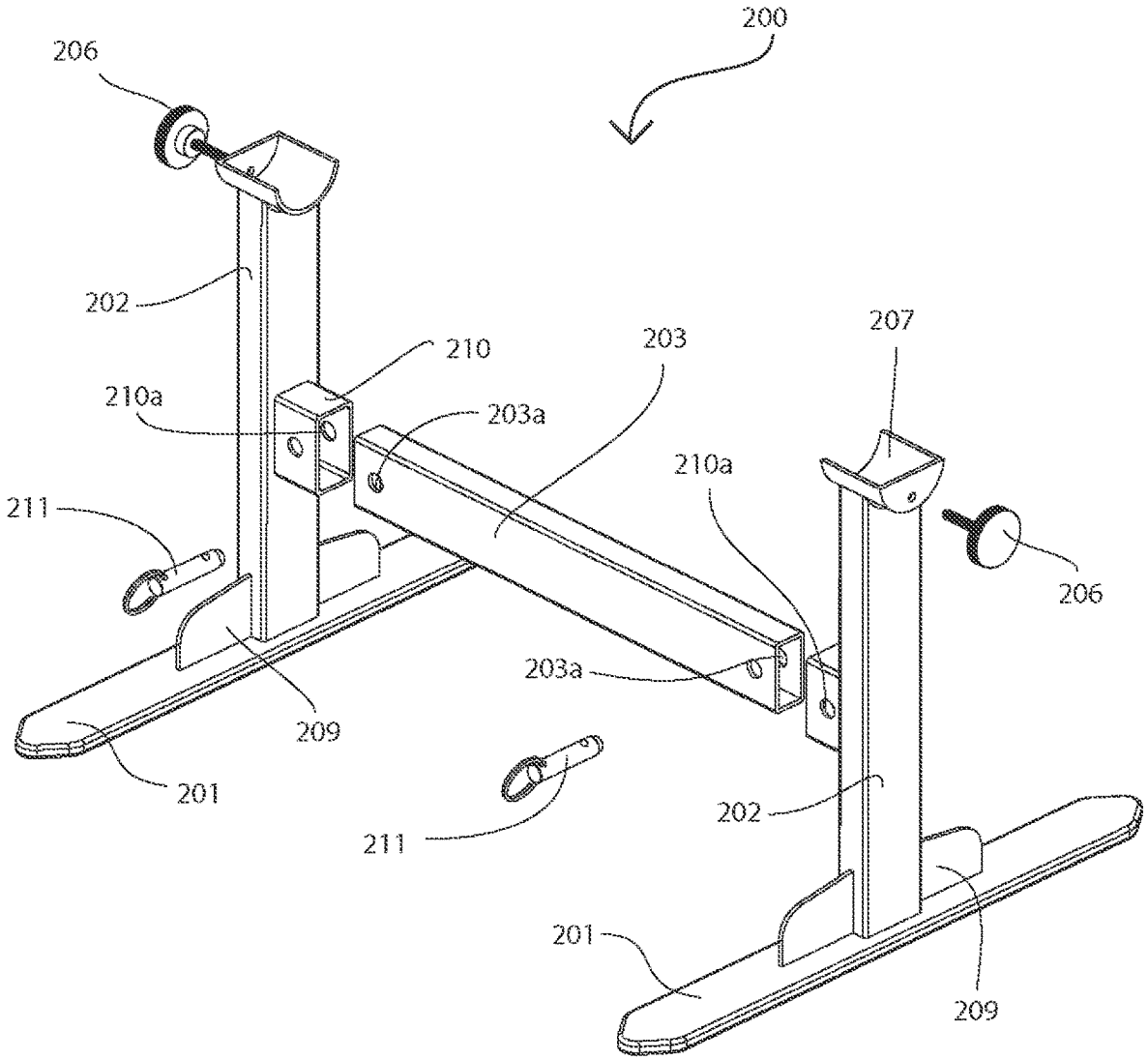
FIG. 8 provides an exploded perspective view of an exercise attachment device, according to an embodiment of the present invention.

In some embodiments, as shown in FIGS. 7-8, the exercise elevating device 200 may be configured to break down into components allowing each of the parallel legs 202 to be separated for ease of transportation, according to an embodiment of the present invention. FIG. 7 provides a front view of the assembled device 200, and FIG. 8 provides an exploded view of the device 200. The device may maintain two elongated legs 202 and attached together with a crossmember 203. The elongated legs 202 may have a sled 201 attached to the distal end 202*a* and a receiver 207 attached to the proximal end 202*b*. The receiver may have a fastener 206 operable to secure a base member of the weightlifting system 1000 to the elevating device 200. The elongated legs 202 may have a flange 210 sized to receive the crossmember 203, flange's 210 geometry may be complementary to the crossmember 203. The flange 210 may have a through-hole 210*a*, and the crossmember 203 may have a through-hole 203*a* which has the same geometry. The flange 210 and crossmember 203 may be secured together with a pin 211 (e.g., screw and bolt, cotter pin) inserted through the through-hole 203*a*. In some embodiments, the flange 210 may have on one side a fixed bolt operable to receive a screw. In such embodiments, the crossmember 203 may have a varying length enabling the nesting characteristics of the device of FIG. 6. and the receiver 207 may be removable and replaceable using the same methods of the crossmember removal 203. The vertical support device 200 may include multiple cross members 203 of varying lengths, allowing the user to adjust the width of the vertical support device 200 to adapt it to weightlifting systems having base members of varying lengths. The crossmember 203 and the elongated legs 202 may have a cross-sectional geometry that is substantially square, rectangular, circular, hexagonal, or other appropriate shapes.

Figure 9:
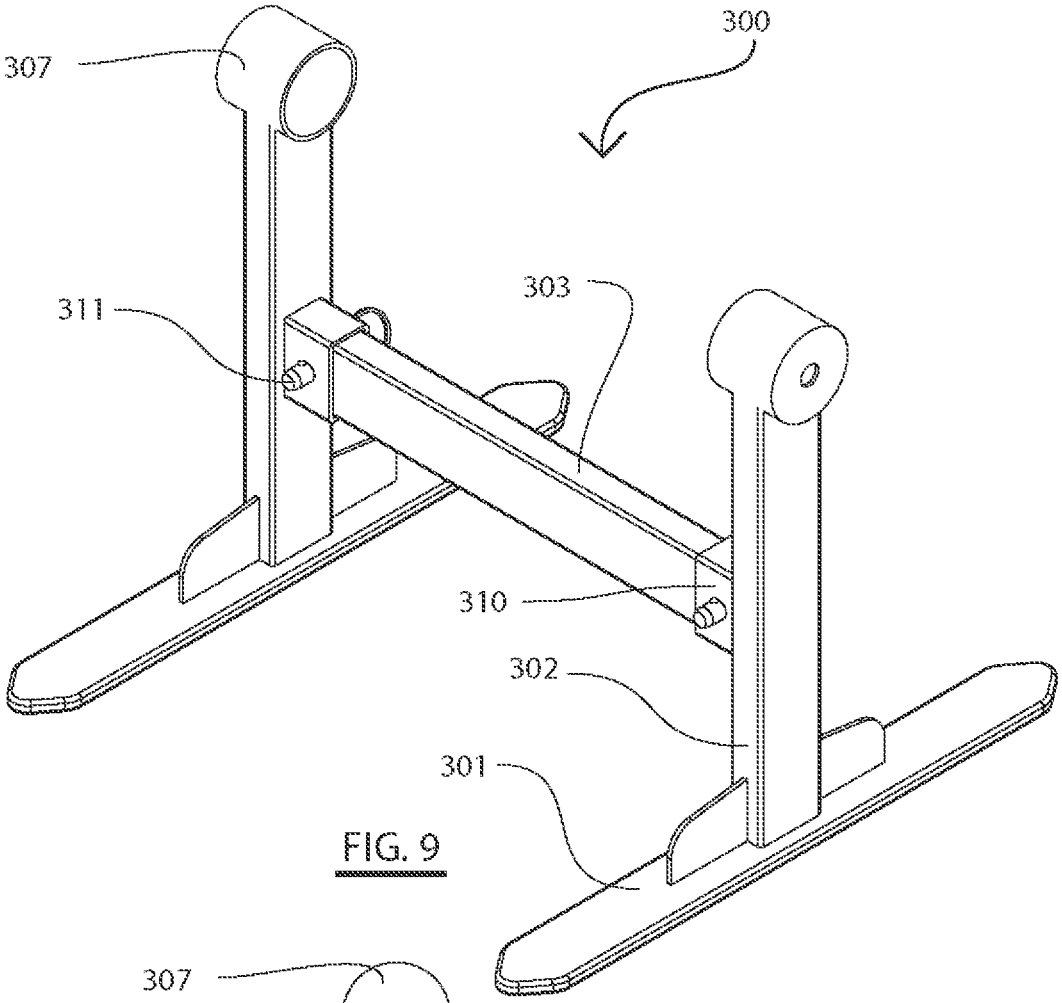
FIG. 9 provides a perspective view of an exercise attachment device, according to an embodiment of the present invention.
Figure 10:
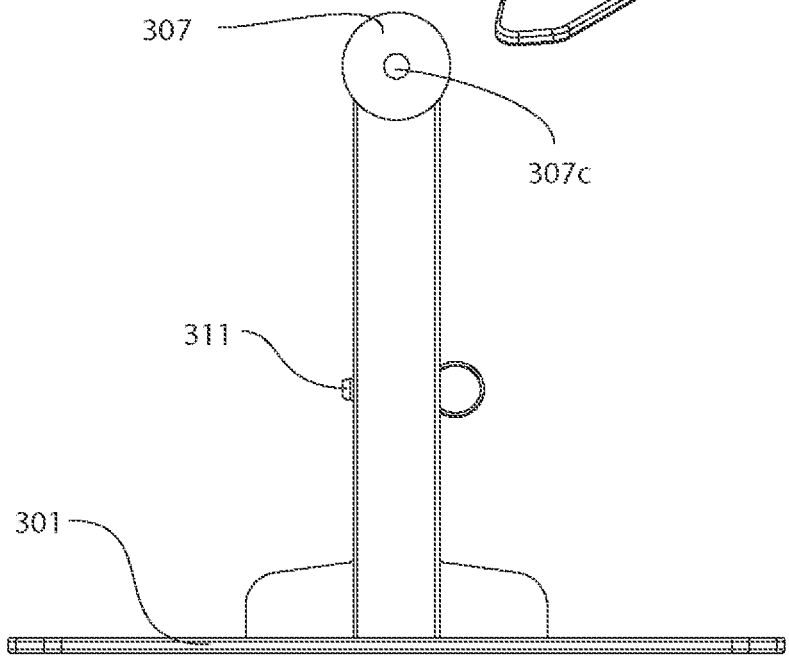
FIG. 10 provides a perspective view of an exercise attachment device, according to an embodiment of the present invention.
Figure 11A:
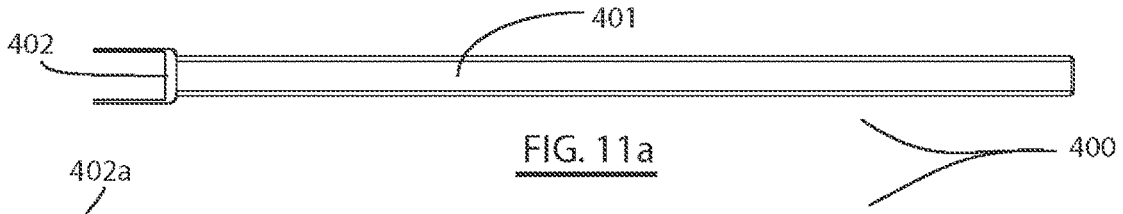
FIG. 11*a* provides a front view of an exercise attachment device, according to an embodiment of the present invention.
Figure 11B:
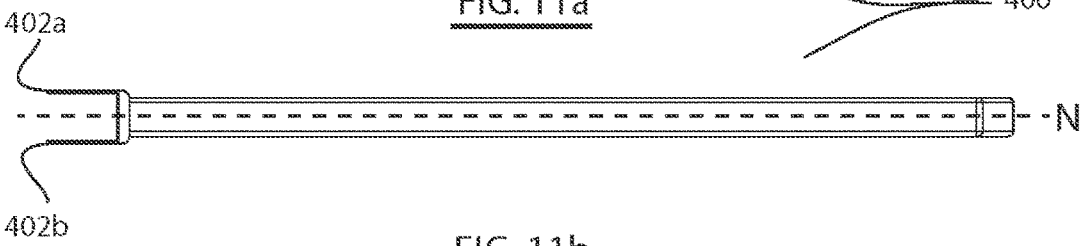
FIG. 11*b* provides a rear view of an exercise attachment device, according to an embodiment of the present invention.
Figure 11C:
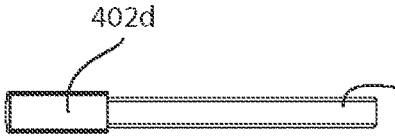
FIG. 11*c* provides a bottom view of an exercise attachment device, according to an embodiment of the present invention.
Figure 11D:
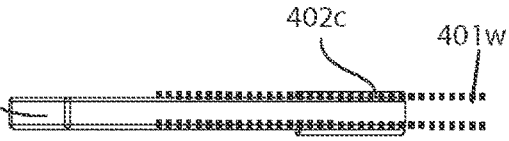
FIG. 11*d* provides a top view of an exercise attachment device, according to an embodiment of the present invention.
Figure 12:
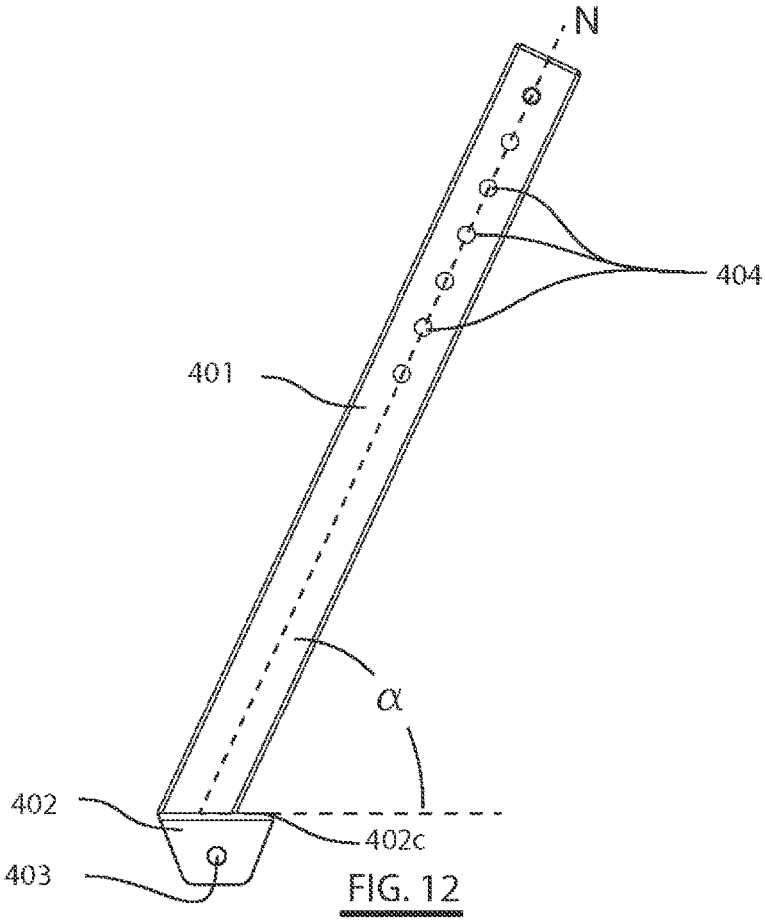
FIG. 12 provides a side view of an exercise attachment device, according to an embodiment of the present invention.

In some embodiments, the elevating device 300 may have a receiver 307 that has a circular geometry shown in FIGS. 9-10 and may be secured concentrically around the base member of the weightlifting system 1000. In such embodiment, the vertical support device may be of the knockdown type described in FIGS. 7-8 and eliminates the threaded screw 206 of device 200. The system may maintain symmetry and the two elongated legs 302 and sleds 301. The legs may have flanges 310 operable to receive a pin 311 through the through-hole (not shown). The crossmember 303 may have varying lengths operable to configure the vertical support device 300 as described by comparing FIG. 2 and FIG. 6, and the elevating device 100 may rotate about the neutral axis of the receiver 307 during relocation or resistance modifications. The vertical support device 300 may include multiple cross members 303 of varying lengths, allowing the user to adjust the width of the vertical support device 300 to adapt it to weightlifting systems having base members of varying lengths.

Figure 28:
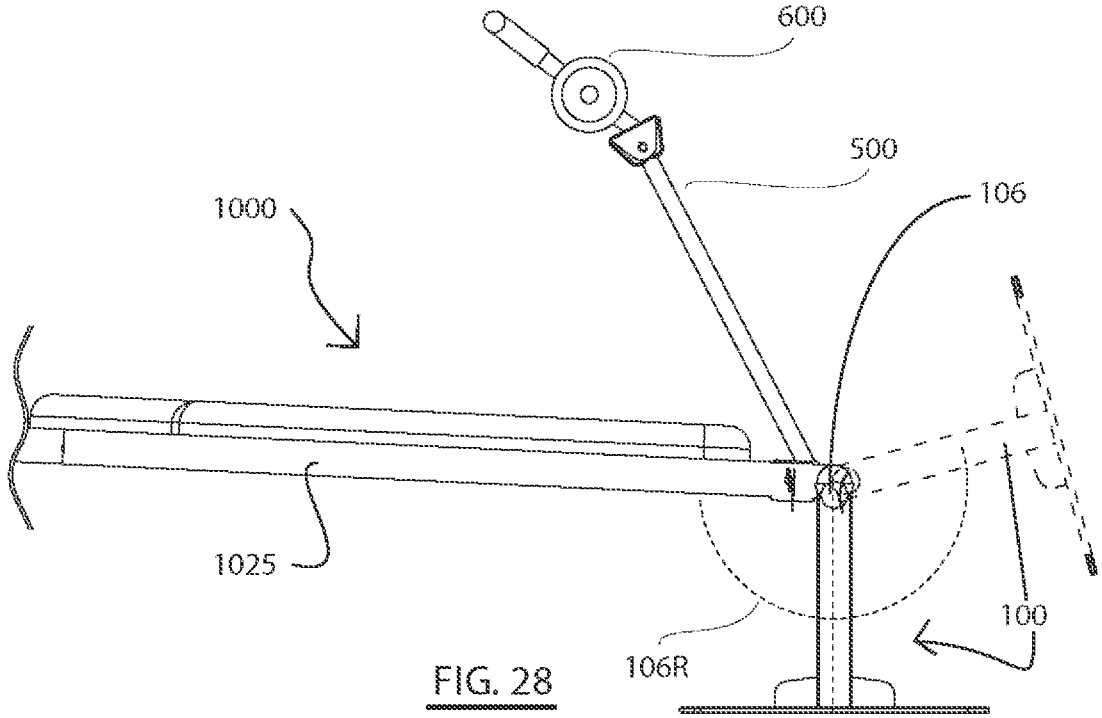
FIG. 28 provides a cropped view of an exercise attachment device of FIGS. 1-10 elevating the inclinable exercise device, according to an embodiment of the present invention.

In some embodiments, the vertical support devices 100, 200, 300 may be attached to the weightlifting system 1000 and may rotate about the shaft of screw 206 and along receivers 207 interior surface. In such embodiments, the system may be adjusted to change the incline of a pad or bench of the weightlifting system without a user having to disassemble the system or remove the vertical support devices from weightlifting system 1000. FIG. 28 provides a side view of a weightlifting system 1000 attached to a vertical support device 100. Device 100 may be secured to a base member of the system 1000, and fastener 106 may be secured to the base member 1020, and device 100 may be rotatable along the path 106R.

Figure 13:
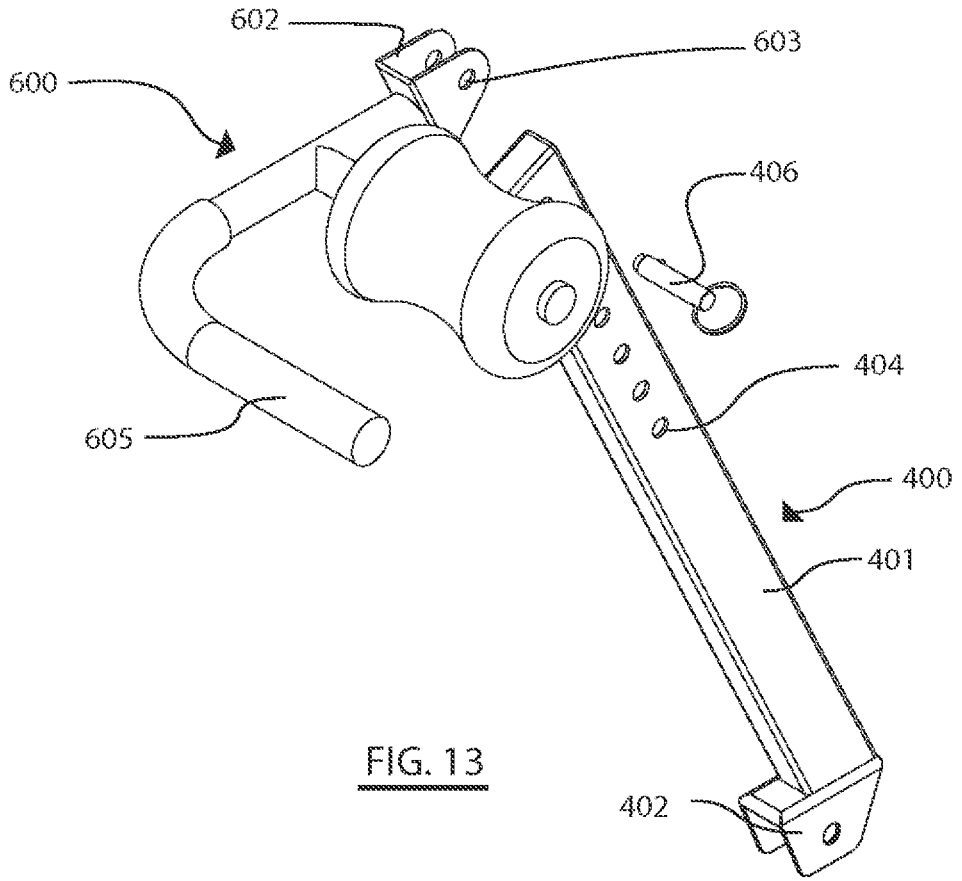
FIG. 13 provides an exploded environmental perspective view of an exercise attachment device, according to an embodiment of the present invention.
Figure 14:
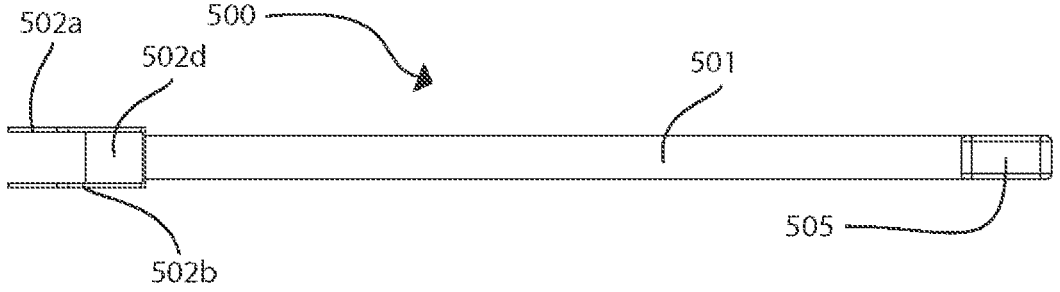
FIG. 14 provides a frontal view of an exercise attachment device, according to an embodiment of the present invention.
Figure 15:
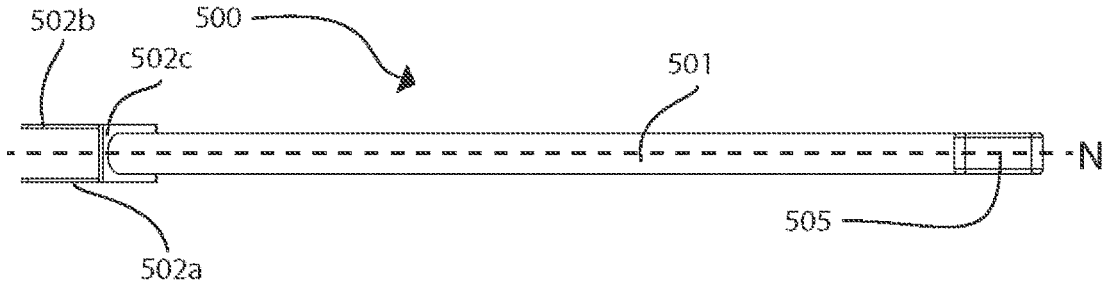
FIG. 15 provides a rear view of an exercise attachment device, according to an embodiment of the present invention.
Figure 16:
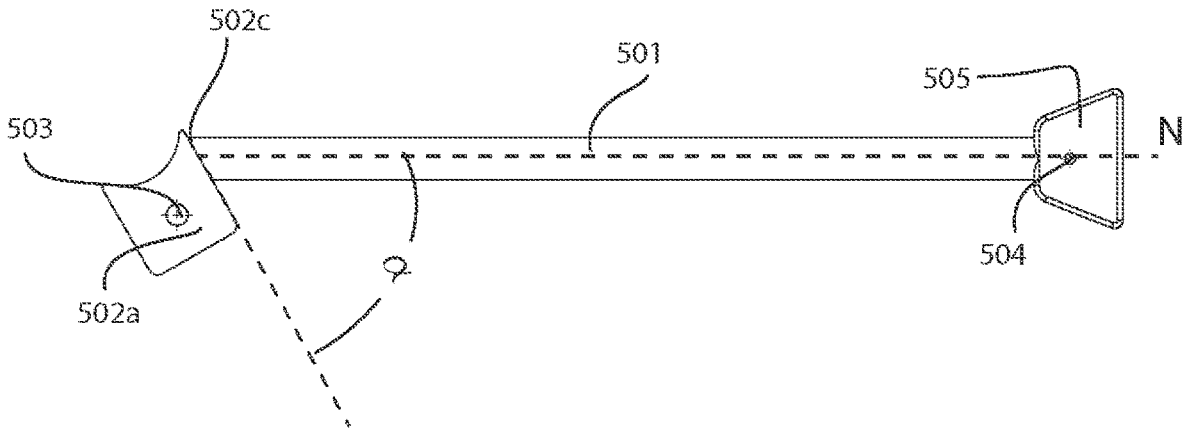
FIG. 16 provides a side view of an exercise attachment device, according to an embodiment of the present invention.
Figure 17A:
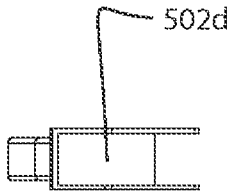
FIG. 17*a* provides a bottom view of an exercise attachment device, according to an embodiment of the present invention.
Figure 17B:
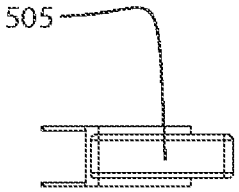
FIG. 17*b* provides a top view of an exercise attachment device, according to an embodiment of the present invention.
Figure 18:
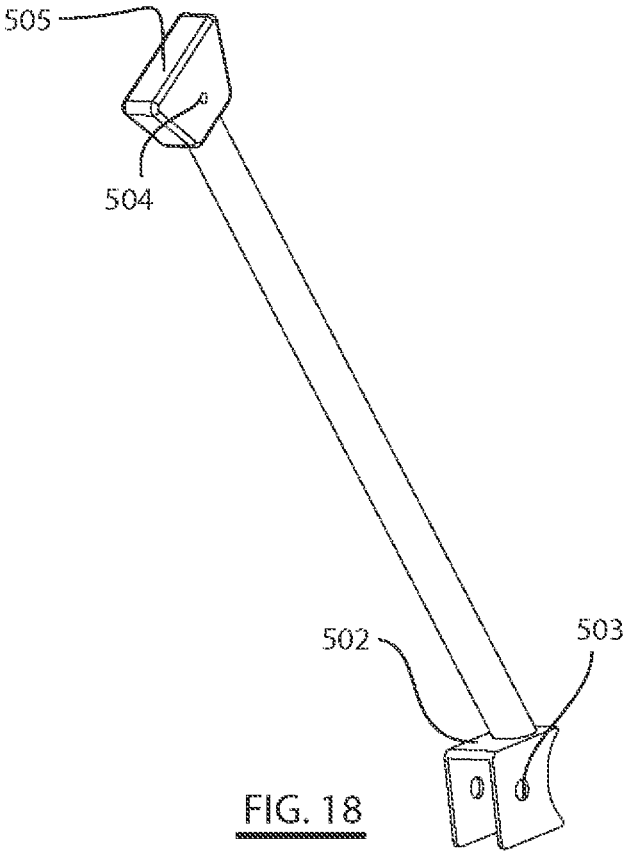
FIG. 18 provides a perspective view of an exercise attachment device, according to an embodiment of the present invention.

The present invention concerns an attachment adapter device that may be incorporated into an inclinable exercise device, a user-manipulated weightlifting system using a user's body weight, or other weight lifting equipment. FIGS. 11*a*-13 provide views of the attachment adapter device 400 (e.g., attachment arm) according to the present invention. The adapter device 400 has an elongated arm 401, bracket 402, and a plurality of pinholes 404. The bracket 402 may be comprised of two flanges 402*a* and 402*b* that have a distance operable to receive the railing of the exercise system 1000 and may be secured to the device with a pin at through-hole 403 on the flange 402. The bracket 402 may have an interior surface 402*d* therebetween the two parallel flanges 402*a*, 402*b*, and a top surface 402*c*. The through-hole 403 has a distance from the interior surface 402*d* such that the interior surface 402*d* may lay flush on the railing of the exercise system. The elongated arm 401 may have a central axis N (e.g., neutral axis) that may align with the plurality of pinholes 404 and defines a plane of symmetry symmetrically position between the two parallel flanges 402*a*, 402*b*, shown in FIG. 11*b*. The central axis N of the elongated arm 401 has an angular position with respect to the top surface 402*c* of the bracket 402 defined by the angle α shown in FIG. 12. The angle α may be an oblique angle (e.g., an acute angle) ranging from 30° to 90° with respect to the top surface 402*c*. FIG. 13 provides an environmental view of the attachment adapter device 400 and an exercise attachment 600 placed thereon the elongated arm 401. The exercise attachment 600 may have a bracket 602 with through-holes 603. The attachment 600 may be slid along the elongated arm 401, and the through-hole 603 may be aligned with one of the pinholes 404, and the attachment 600 may be secured to the elongated arm with the pin 406. The elongated arm may be manufactured from weldable materials such as steel, aluminum, molded from carbon fiber composites, structural plastics, and the like. The width of the elongated arm 401*w* may provide a gap that allows for attachment to a plurality of different attachments 600 from various manufactures.

The exercise attachment 600 illustrated in the figures is an exemplary wing attachment and not limiting the device to specific attachments with the same features. A plurality of different attachments may be used in conjunction with the attachment arm 400. The factor of limiting an exercise attachment's incorporation to the attachment arm is dependent on the bracket depth 602 and the through-hole 603 diameter, and the attachment arm pinhole diameter 404.

Figure 19:
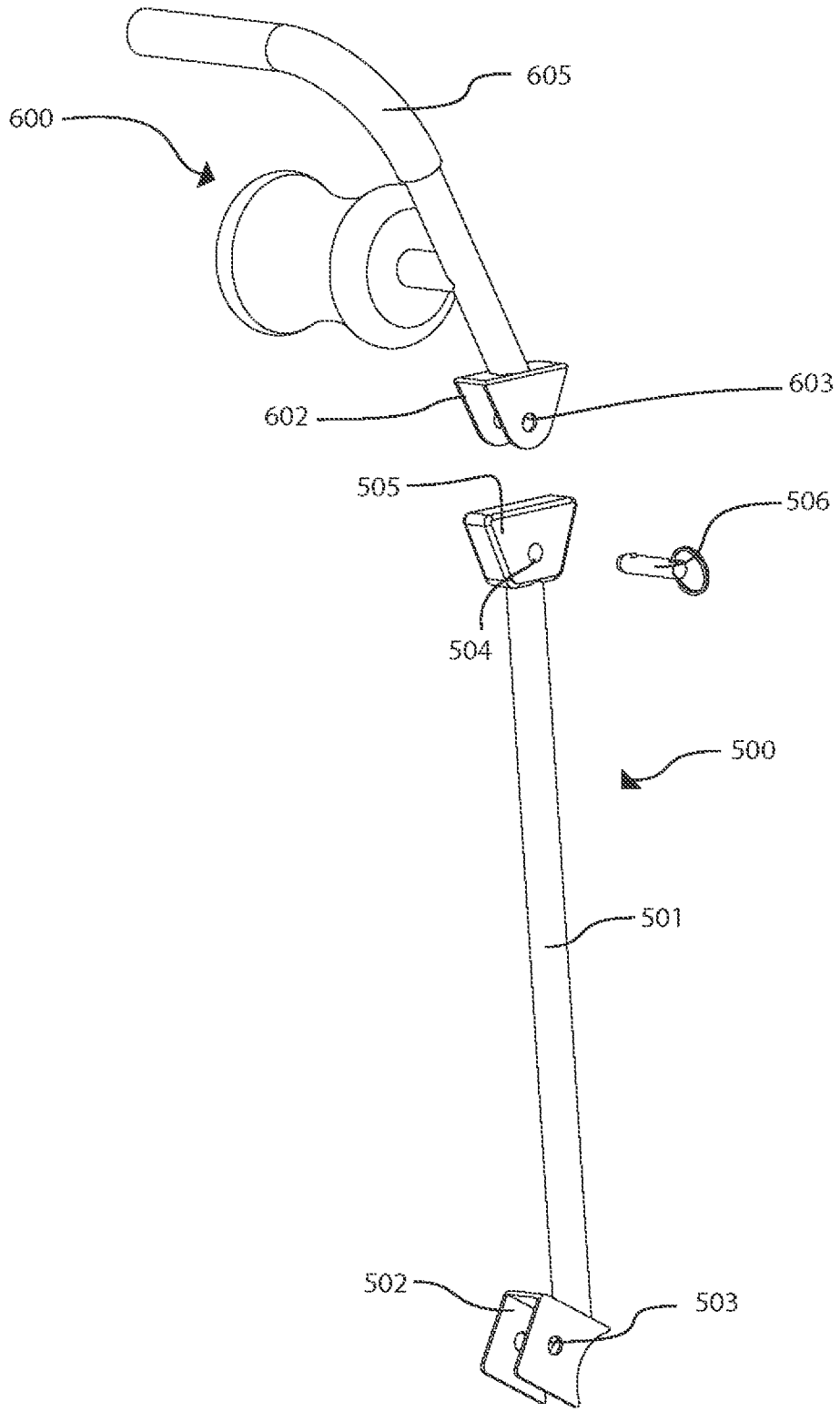
FIG. 19 provides an exploded environmental perspective view of an exercise attachment device, according to an embodiment of the present invention.

The present invention concerns an attachment adapter device that may be incorporated into an weightlifting system that employ's the user's body weight, or other weight lifting equipment. FIGS. 14-19 provide views of the attachment adapter device 500 according to an embodiment of the present invention. The adapter device 500 has an elongated arm 501, bracket 502, and a receiving bracket 505. The bracket 502 may have two flanges 502*a* and 502*b* with a distance from each other that may be operable to secure the bracket to the inclinable exercise device 1000 and may be secured to the railing with a pin at through-hole 503 of bracket 502. The bracket 502 may have an interior surface 502*d* therebetween the two parallel flanges 502*a*, 502*b*. and a top surface 502*c*. The through-hole 503 has a distance such that the interior surface 502*d* may lay flush on the railing of the inclinable exercise device. The receiving bracket 505 may have a pinhole 504 operable to receive an exercise attachment. The elongated arm 501 may have a central axis N that may align between the two parallel flanges 502*a*, 502*b* and defines a plane of symmetry, shown in FIG. 15. The central axis N of the elongated arm 501, has an angular position with respect to the top surface 502*c* of the bracket 502 defined by the angle α shown in FIG. 16. The angle α may be an oblique angle (e.g., an acute angle) ranging from 30° to 90° with respect to the bracket top surface 502*c*. FIG. 19 provides an environmental view of the attachment adapter device 500 and an exercise attachment 600 placed on the receiving bracket 505. The exercise attachment 600 may have a bracket 602 with through-holes 603. The through-hole 603 may be aligned with one of the pinholes 504 of the receiving bracket 505, and the attachment 600 may secure to the elongated arm with the pin 506.

The present invention provides a method of configuring an exercise system having an inclinable element (e.g., a bench or pad) with an attachment adapter device and an elevation device. FIGS. 20-29 provides views of an exemplary exercise system 1000, incorporating two of vertical support devices 100A and 100B, the attachment adapter device 500/400, and the attachment 600. For example, the exemplary exercise system 1000 may have a base frame 1005, supporting an inclinable frame 1025 that houses a track system and roller system (not shown), the rollers may be attached to the pad 1060 and provides a moving ground (platform) in the range 1060S shown in FIG. 24. The inclinable frame 1025 may be connected to the base frame with a telescopic member 1040 that may nest in between the two inclinable frames 1025 rails. The telescopic member 1040 may be pivotally attached to a slide 1050 that may be operable to slidably engage with the base frame 1005 and may be fixed in place with a pin at the various support position 1015. The base of the frame may have a base member 1010 (e.g., base ground), and the inclinable frame 1025 may have base member 1020 (e.g., elongating ground). Slide 1050 may provide a control system for a user to configure the resistance of the system. In some embodiments, as the slide 1050 is lowered the length of the exercise system 1000 is increased, where the length is a distance from the base member 1010 to the base member 1020. Depending on a user's workout and the system's configuration, the system's resistance may increase or decrease for a specific exercise. The base frame 1005 may typically remain fixed in the starting position shown, and the inclinable frame 1025 may slidably elongate as the system is deployed to the open position. The elevation device 100 may be operable to raise the exercise system 1000 off the ground and enables a user to configure one's feet to be coplanar with the ground and increase the resistance of the device without destroying the original functions of the device.

Figure 20:
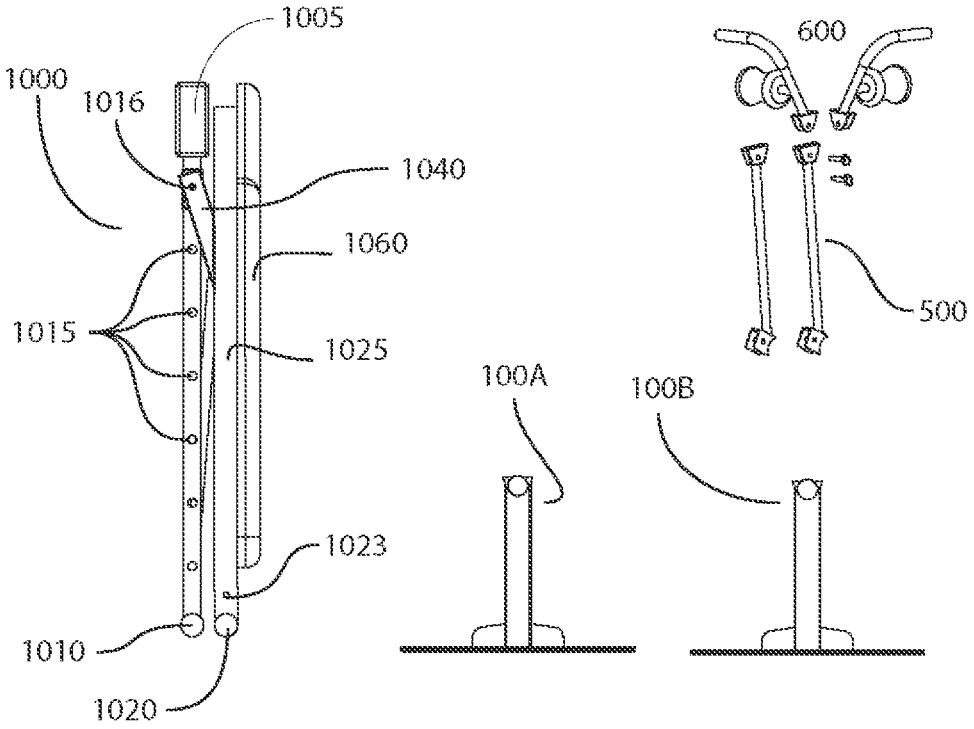
FIG. 20 provides an environmental view of the exercise attachment device of FIGS. 1-10 and FIGS. 11-19 with an inclinable exercise device configured in a closed position, the inclinable exercise device, and the attachment devices in a deconstructed configuration, according to an embodiment of the present invention.
Figure 21:
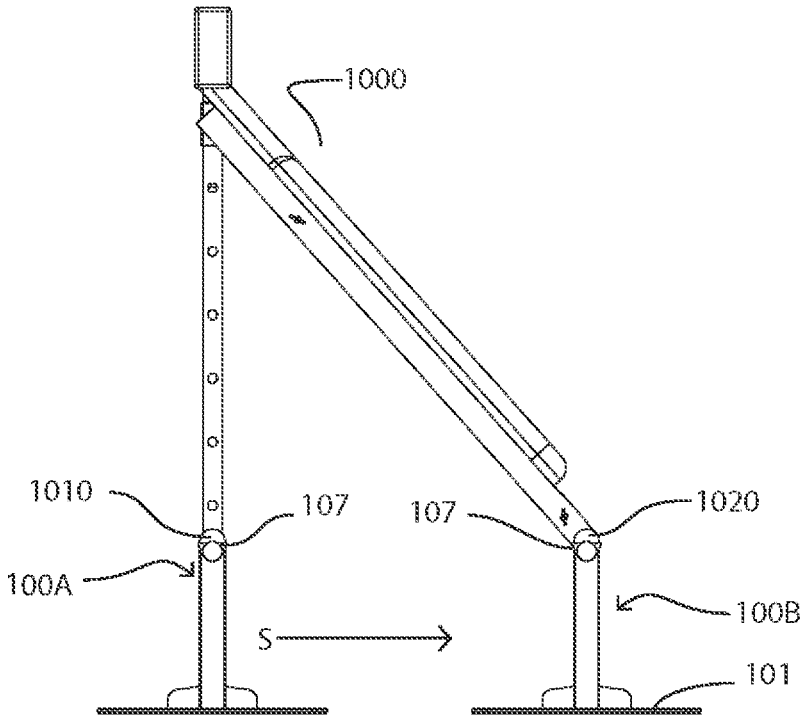
FIG. 21 provides an environmental view of the exercise attachment device of FIGS. 1-10 elevating the inclinable exercise device and shows the inclinable exercise device in a semi-open position, according to an embodiment of the present invention.
Figure 22:
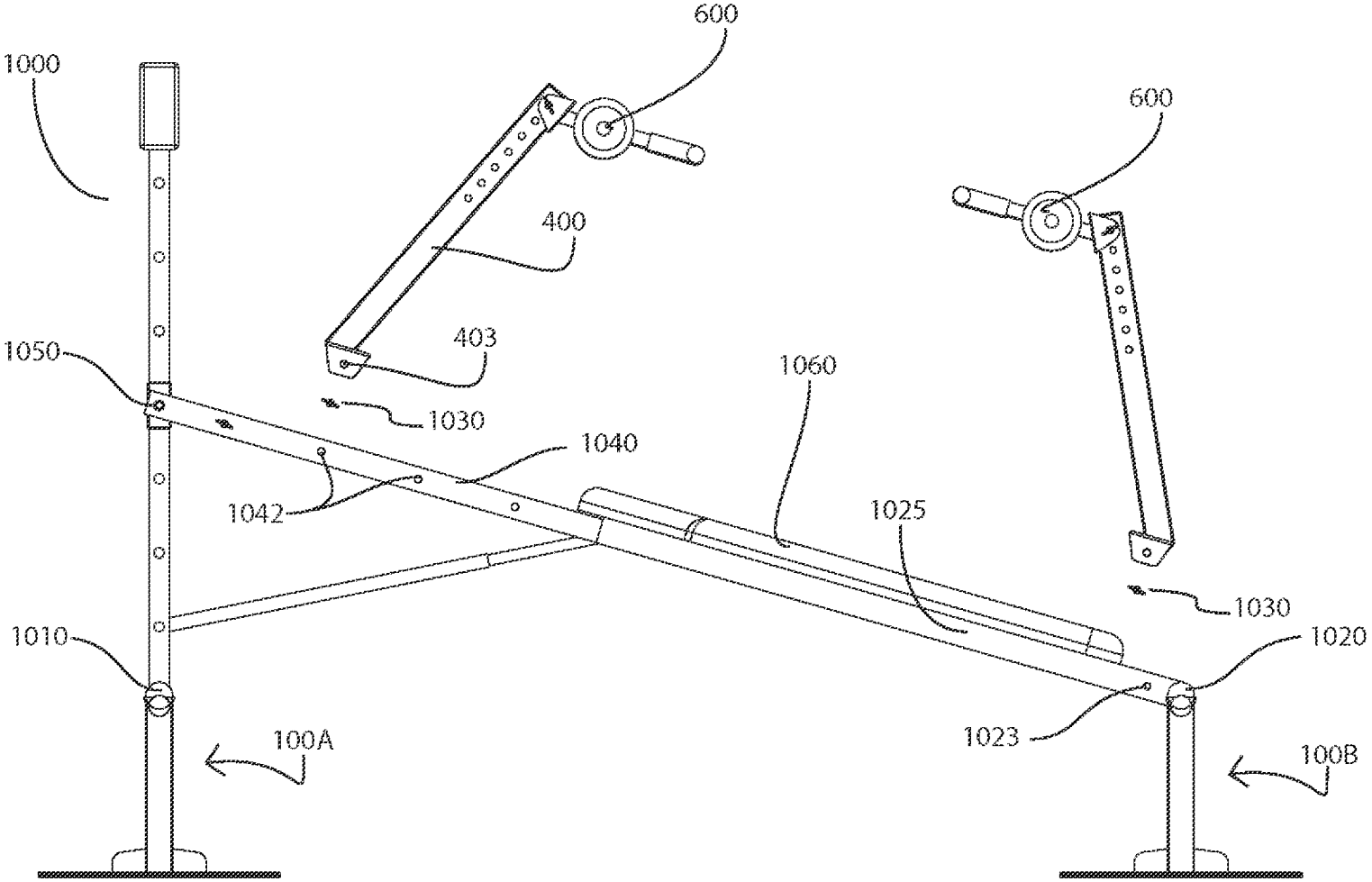
FIG. 22 provides an environmental view of the exercise attachment device of FIGS. 1-10 elevating the inclinable exercise device and shows the inclinable exercise device in an open position, and shows the exploded configuration of the exercise attachment device of FIGS. 11-13, according to an embodiment of the present invention.
Figure 24:
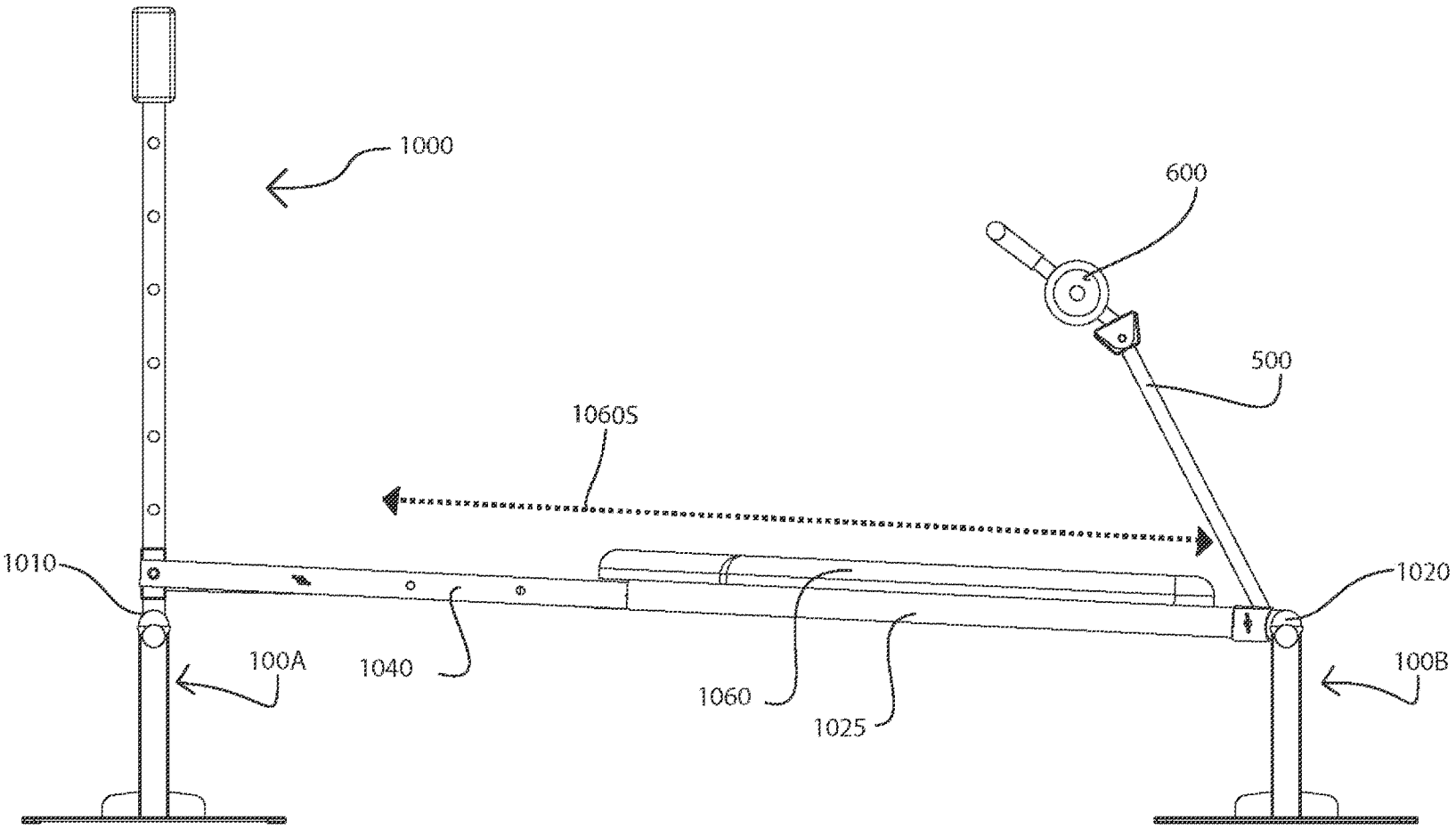
FIG. 24 provides an environmental view of the exercise attachment device of FIGS. 1-10 elevating the inclinable exercise device and shows the inclinable exercise device in the open configuration with the exercise attachment device of FIGS. 14-19 secured to the inclinable exercise device, according to an embodiment of the present invention.
Figure 25:
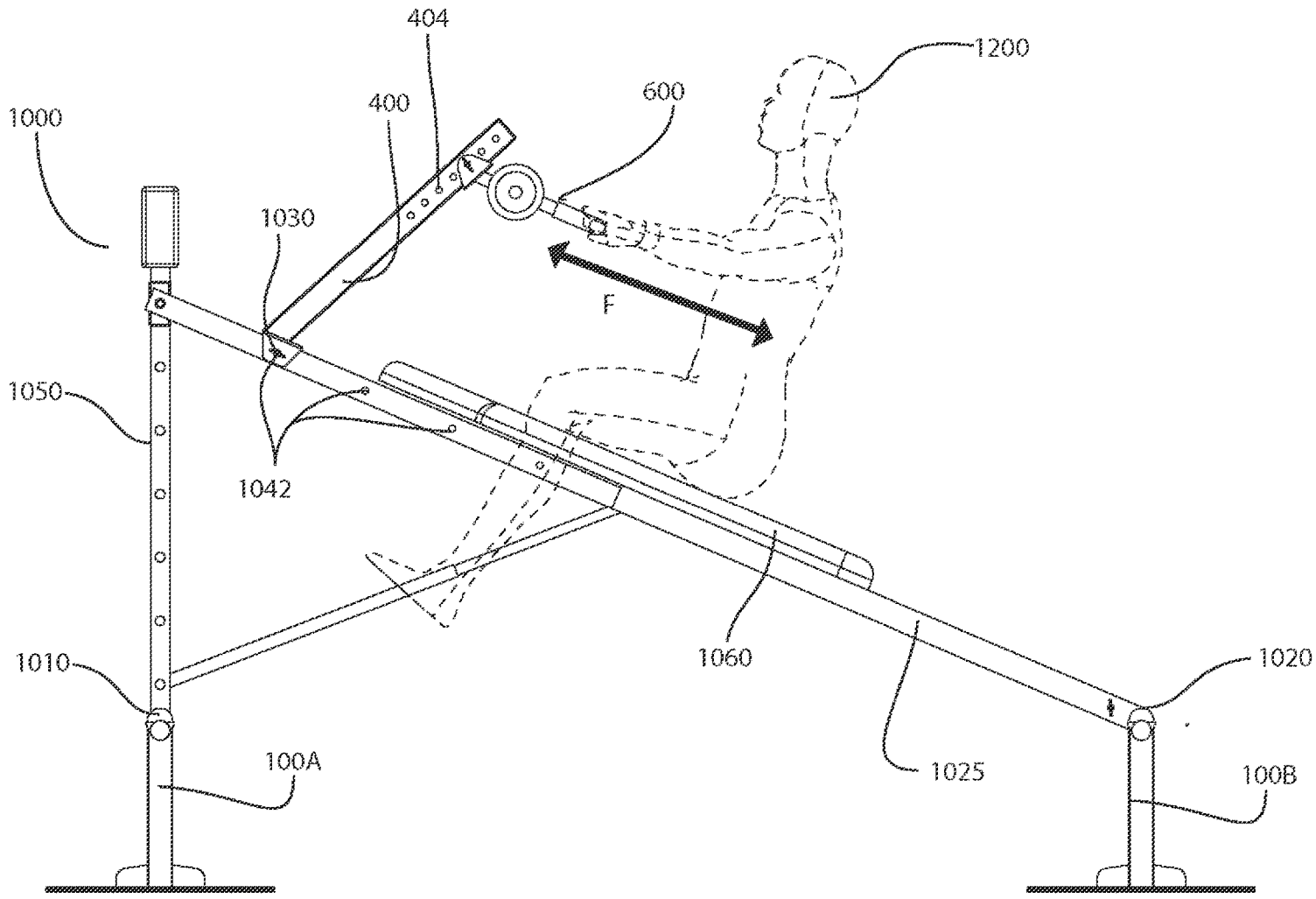
FIG. 25 provides an environmental view of the exercise attachment device of FIGS. 1-10 elevating the inclinable exercise device and shows the inclinable exercise device in an open configuration with the exercise attachment device of FIGS. 11-14 secured to the inclinable exercise device, and a user performing an exercise, according to an embodiment of the present invention.
Figure 26:
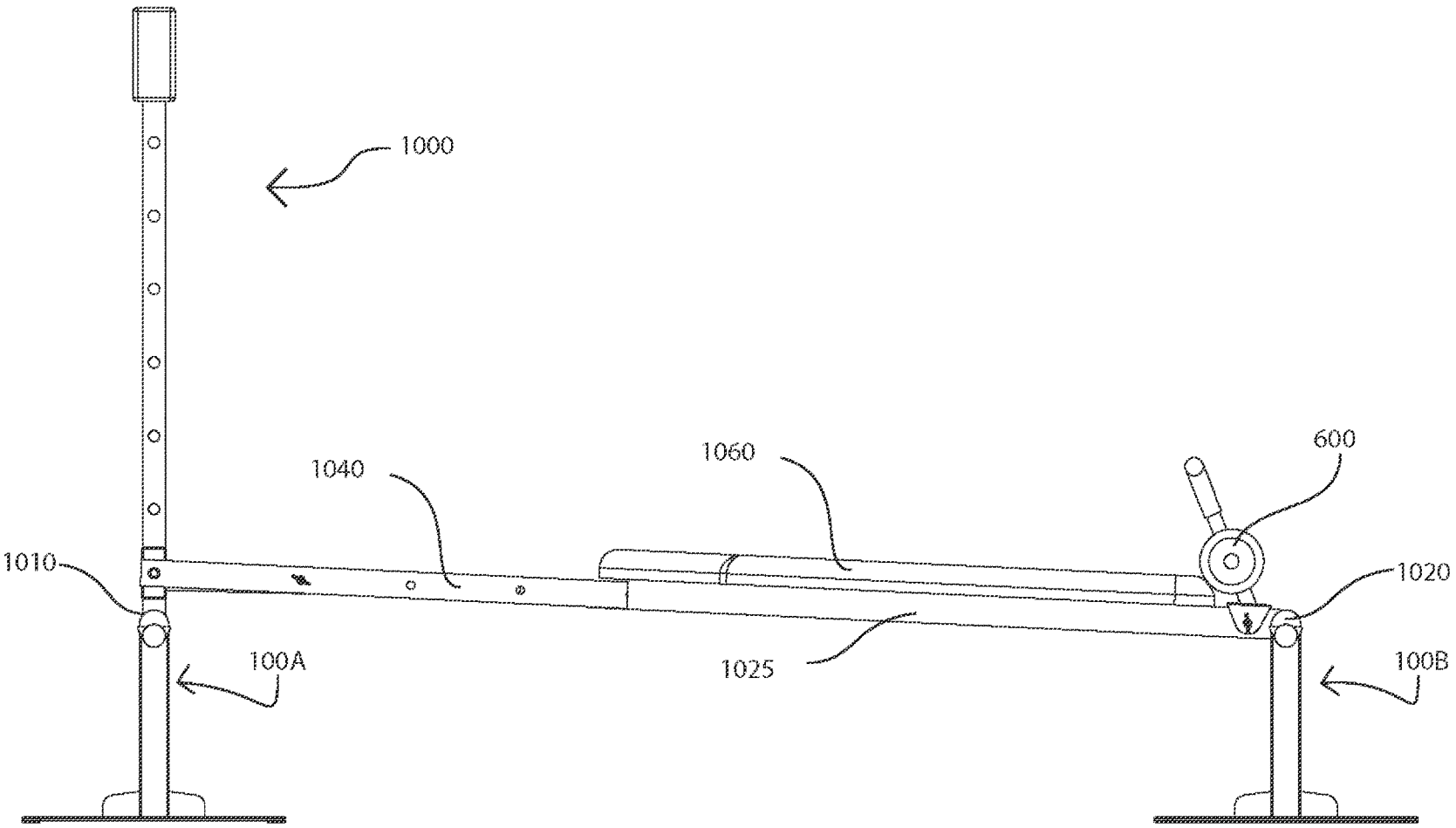
FIG. 26 provides an environmental view of the exercise attachment device of FIGS. 1-10 elevating the inclinable exercise device and shows the inclinable exercise device in the open configuration, according to an embodiment of the present invention.
Figure 29:
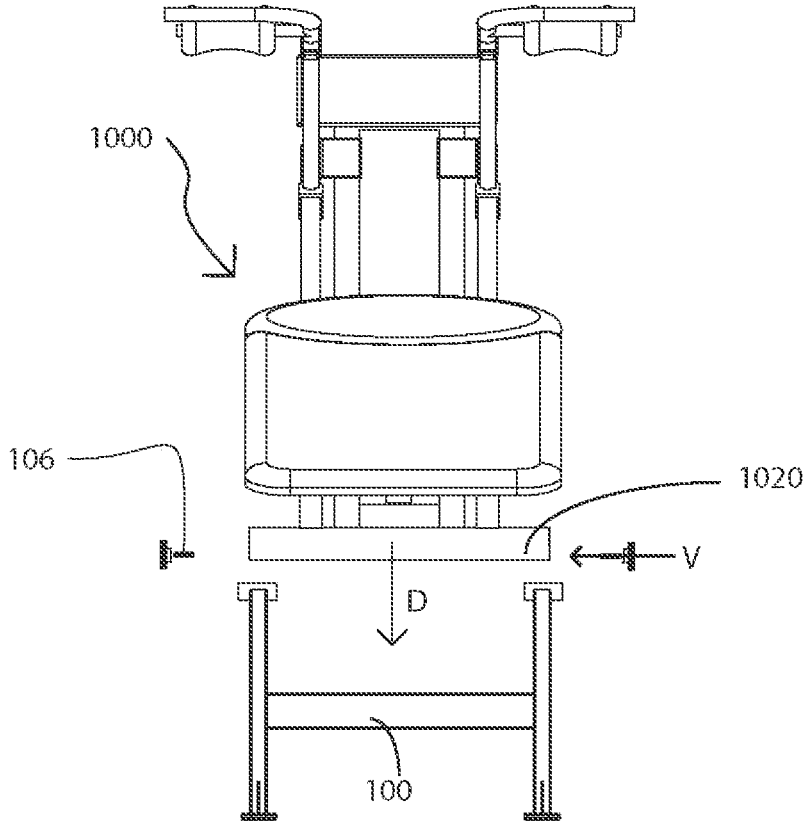
FIG. 29 provides an exploded front view of the device according to an embodiment of the present invention.

FIG. 20 provides a deconstructed view of the system of the present invention, including the exercise system 1000 in the closed position. The base ground 1010 may interface with a first vertical support device 100A, and the elongating ground 1020 may interface with a second vertical support device 100B. The exercise attachment device 500, attachment 600, and the two frame interfaces 100A and 100B are not attached to the exercise device 1000. The components are operable to be modularly attached and are not fixedly secured to the exercise device 1000. FIG. 29 provides a frontal view of the exercise device 1000 being lowered onto the elevating device 100. The elevating device may be lowered onto the receiver 107 as indicated by the directional vector D and the fastener 106 may be threaded into the elongating ground 1020 as indicated by the directional vector V. FIG. 21 provides an exemplary illustration of the exercise system 1000 configured in a semi-open position and shows the base frame member 1010 nested in the receiver 107 of the vertical support device 100A and the inclinable frame base member 1020 nested into the receiver 107 of the vertical support device 100B. As the user begins to lower the slide 1050 the extended base member 1020 may slide away from the base frame 1005 in the direction indicated by the vector line S, and the sleds 101 may provide a surface and geometry, allowing the inclinable frame 1025 to slide to the position shown in FIG. 22. The telescopic rail 1040 may have a plurality of mounting holes 1042 operable to receive the attachment arm 500. The inclinable frame 1025 may have a mounting hole 1023 which may be operable to receive the attachment arm 500. The exercise attachment 600 may be secured to the selected attachment adapter 400, 500 before or after the attachment adapter secures to the exercise device 1000. Either of the exemplary attachment adapters 400, 500 may be attached to the exercise device as shown in FIGS. 23-28. The inclinable frame 1025 may be configured as shown in FIG. 24 with the pad 1060 substantially parallel with the ground plane, providing low resistance to a user when exercising. The attachment arm 500 may be attached to the inclinable frame mounting hole 1023, and the telescopic rail mounting holes 1042. The various mounting hole locations 1042, 1023 allow a user to configure the system for different exercises. The configuration of the inclinable frame 1025, the attachment arm 500, and the exercise attachment 600 facilitates a user to perform an assisted bench press. As illustrated in FIG. 26, the system provides a configuration without the attachment arm 500 and is operable to perform a shoulder press. The vertical support devices 100A, 100B facilitate a user to mount and dismount the pad 1060 without interacting substantially with the ground.

Figure 23:
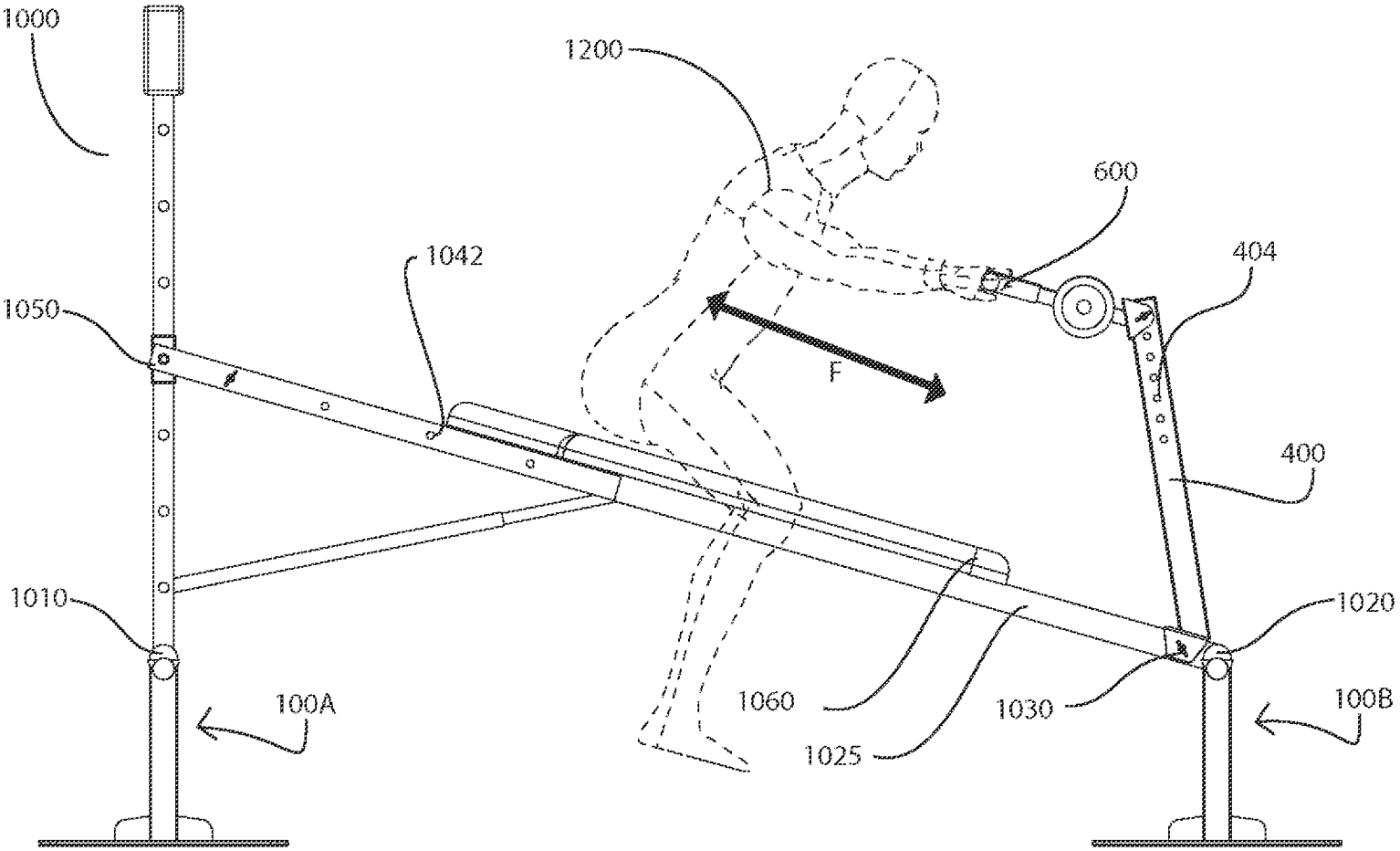
FIG. 23 provides an environmental view of the exercise attachment device of FIGS. 1-10 elevating the inclinable exercise device and shows the inclinable exercise device in an open configuration with the exercise attachment device of FIGS. 11-13 secured to the inclinable exercise device, and a user performing an exercise, according to an embodiment of the present invention.

FIG. 23 provides a view of the exercise system 1000 configured at an intermediate resistance and user 1200 performing a bench-pressing motion, where the user 1200 maintains their chest and spine perpendicular to the platform 1060, and a user 1200 may engage the muscles in their chest, arms, shoulder, and core to push their chest away from the exercise attachment 600, as illustrated by the force vector F. The exercise attachment arm 400, 500 may be secured to the inclinable frame 1025 with a pin 1030 through the mounting hole 1023. The resistance for this exercise may be decreased as slide 1050 is lowered down the frame 1005 and secured to a lower hole 1015 in the system, the inverse will increase resistance. Mounting the exercise attachment 600 to different pinholes 404 of the attachment arm 400 may allow a user to configure the system for isolating specific regions of the muscle group exercised. The minimum resistance for this exercise may be selected when a user configures the system, as shown in FIG. 24. Another exercise enabled by the incorporation of the vertical support device 100, and attachment arm 600 is an upright row. FIG. 25 provides a view of the inclinable exercise device 1000 in the maximum resistance configuration and the user 1200 performing a rowing exercise, where the user 1200 may maintain their chest and spine parallel to the platform, and a user may engage the muscles in their upper back, arms, shoulder, and core to pull their chest up to the exercise attachment 600, as illustrated by the force vector F. The exercise attachment arm 400, 500 may be mounted to other holes 1042 of the telescopic rails 1040. In embodiments using the exercise attachment arm 400, a user may decide to attach the exercise attachment 600 to a different pinhole 404 on the attachment arm, as illustrated in FIG. 404. The various pinholes 404 are operable to enable a user to configure the equipment such that a user can focus on specific muscle groups or regions of a muscle when performing the exercise.

Figure 27:
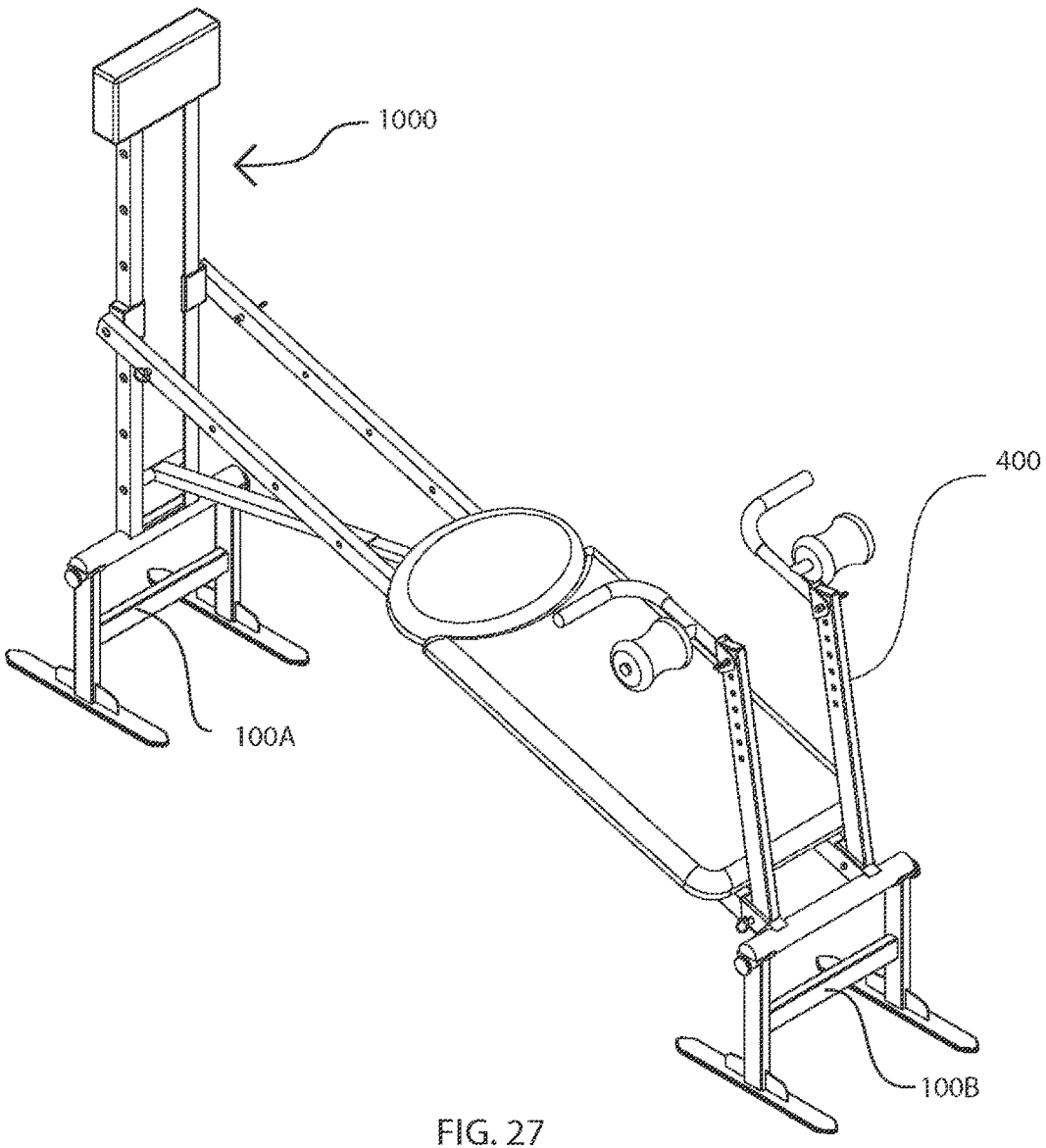
FIG. 27 provides an environmental perspective view of the exercise attachment device of FIGS. 1-10 elevating the inclinable exercise device and shows the inclinable exercise device in an open configuration with the exercise attachment device of FIGS. 11-13 secured to the inclinable exercise device, according to an embodiment of the present invention.

FIG. 26 provides a view of an exemplary exercise system 1000 in the minimum resistance configuration and assembled with the vertical support devices 100A, 100B, and the exercise attachment 600. The exercise device 1000 without the attachment arm adapters 400/500 is only operable to maintain the original functions of the exercise device but enables a user 1200 to be more comfortable when transitioning from different workouts and provides ample space for mounting or dismounting onto the pad 1060. FIG. 27 provides a perspective view of the inclinable exercise device 1000, a first and second vertical support device 100A, 100B, the exercise attachment device 500, and the exercise attachment 600 configured in an assembly according to an embodiment of the present invention.

CONCLUSION/SUMMARY

The present invention provides an exercise attachment device that facilitates a user mounting and dismounting an inclinable weightlifting device and provides an adapter arm that enables a user to configure exercise attachments at ideal locations for a user's body type. The present system is able to configure an inclinable weightlifting device, for a user to perform a variety of bench press and rowing exercises. It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. An exercise system for increasing resistance with an inclinable exercise device that utilizes a user's body weight, the exercise system comprising:

a. an elevating device including:

i. a frame having a pair of parallel legs longitudinally connected with a detachable crossmember, wherein each of the pair of parallel legs has a distal end connected to a sled and a proximal end connected to a receiver, wherein each of the receivers has a geometry operable to receive a base of said inclinable exercise device; and ii. a fastener operable to penetrate through each said receiver's periphery sides and secure said base of the inclinable exercise device to the receivers.

2. The exercise system of claim 1, further comprising a pair of elongated attachment arms each comprising:

i. a bracket including a pair of flanges positioned at a distal end of each of said pair of elongated arms having a through-hole, and ii. a plurality of through-holes along a central axis of each of said pair of elongated arms.

3. The exercise system of claim 2, wherein said pair of elongated attachment arms are operable to fasten to a pair of rails of said inclinable exercise device, wherein each of said pair of rails have pairing holes operable to align and pair with said through holes of each of said pair of elongated arms.

4. The exercise system of claim 3, wherein each of said pair of elongated attachment arms is secured to a through-hole nearest to a frame of said inclinable exercise device to configure said exercise system for said user to perform a rowing exercise.

5. The exercise system of claim 3, wherein each of the pair of elongated attachment arms is secured to a through-hole farthest from a frame of said inclinable exercise device to configure said exercise system for said user to perform a bench press exercise.

6. The exercise system of claim 2, wherein each of said brackets forms an acute angle with said central axis.

7. The exercise system of claim 1, wherein said frame is secured to a base of said inclinable exercise device with said fasteners at a periphery of each of said receivers.

8. The exercise system of claim 1, wherein said sleds have a low coefficient of friction and are operable to slidably engage with a surface, and are operable to provide stability when the exercise system is in use.

9. The exercise system of claim 1, wherein said detachable crossmember has a predetermined length.

10. The exercise system of claim 1, wherein the elevating device is further operable to elevate said inclinable exercise device off a surface at least twelve inches, operable to allow a user to mount and dismount the exercise system without having to lay on the surface.

11. An inclinable weightlifting system that utilizes a user's body weight as resistance, comprising: a. an elevating device including:

i. a frame having a pair of parallel legs longitudinally connected with a detachable crossmember, wherein each of the pair of parallel legs has a distal end connected to a sled and a proximal end connected to a receiver, wherein each of the receivers has a geometry operable to receive a base of an inclinable exercise device; and ii. fasteners operable to connect peripheral sides of each of said pair of receivers to said base of said inclinable exercise device to each of said pair of receivers; and b. an elongated exercise attachment arm including: i. a bracket comprising two parallel flanges connected with a plate ii. an elongated bar secured to a top of said plate, wherein the elongated bar is fixed at an acute angle relative to said plate.

12. The weightlifting system of claim 11, further comprising a second elevating device including: a. a second frame having a second pair of parallel legs longitudinally connected with a second detachable crossmember, wherein each of the second pair of parallel legs has a distal end connected to a second sled and a proximal end connected to one of a pair of second receivers, wherein each of the second receivers has a geometry operable to receive a second base member of the inclinable exercise device.

13. The weightlifting system of claim 12, further comprising the inclinable exercise device having the first base and the second base, wherein said second base includes a vertical member having an adjustable length.

14. The weightlifting system of claim 13, wherein elongating the vertical member increases the angle of the inclinable exercise device relative to a horizontal plane.

15. The weightlifting system of claim 11, further comprising a second elongated exercise attachment arm including: a. a second bracket comprising two second parallel flanges connected with a second plate; and b. a second elongated bar secured to a top of said second plate, wherein the second elongated bar is fixed at an acute angle relative to said second plate.

16. The weightlifting system of claim 15, further comprising first and second detachable handles operable to be attached at various positions on said first elongated bar and said second elongated bar.

17. The weightlifting system of claim 11, wherein said sleds have a low coefficient of friction and are operable to slidably engage with a surface, and is operable to provide stability when the exercise system is in use.

18. An inclinable weightlifting system that utilizes a user's body weight as resistance, comprising: a. an elevating device including: i. a frame having a pair of parallel legs longitudinally connected with a detachable crossmember, wherein each of the pair of parallel legs has a distal end connected to a sled and a proximal end connected to a receiver; and ii. fasteners operable to connect said pair of receivers to a base member of an inclinable sliding exercise bench to each of said pair of receivers.

19. The weightlifting system of claim 18, further comprising an elongated exercise attachment arm including: a. a bracket comprising two parallel flanges connected with a plate; and b. an elongated bar secured to a top of said plate, wherein the elongated bar is fixed at an acute angle relative to said plate.

20. The weightlifting system of claim 19, further comprising a second elevating device including: a. a second frame having a second pair of parallel legs longitudinally connected with a second detachable crossmember, wherein each of the second pair of parallel legs has a distal end connected to a second sled and a proximal end connected to one of a pair of second receivers, wherein each of the second receivers has a geometry operable to receive a second base member of the inclinable sliding exercise bench.

21. The weightlifting system of claim 20, wherein said second base member includes a vertical member having an adjustable length.

* * * * *